US010673135B2

(12) United States Patent
Yu et al.

(10) Patent No.: US 10,673,135 B2
(45) Date of Patent: Jun. 2, 2020

(54) 5G TERMINAL ANTENNA WITH RECONFIGURABLE RADIATION PATTERN

(71) Applicant: SPEED WIRELESS TECHNOLOGY INC., San Jose, CA (US)

(72) Inventors: Bin Yu, Suzhou (CN); Xiaoyang Ma, Suzhou (CN)

(73) Assignees: SPEEDLINK TECHNOLOGY INC., Cupertino, CA (US); HUIZHOU SPEED WIRELESS TECHNOLOGY CO., LTD, Huizhou, Guangdong (CN)

( * ) Notice: Subject to any disclaimer, the term of this patent is extended or adjusted under 35 U.S.C. 154(b) by 67 days.

(21) Appl. No.: 15/724,229

(22) Filed: Oct. 3, 2017

(65) Prior Publication Data

US 2018/0309198 A1 Oct. 25, 2018

(30) Foreign Application Priority Data

Apr. 20, 2017 (CN) ..... 2017 1 0261516

(51) Int. Cl.
*H01Q 3/24* (2006.01)
*H01Q 1/24* (2006.01)
(Continued)

(52) U.S. Cl.
CPC ..... *H01Q 3/24* (2013.01); *H01Q 1/243* (2013.01); *H01Q 3/36* (2013.01); *H01Q 9/285* (2013.01);
(Continued)

(58) Field of Classification Search
CPC ..... H01Q 1/243; H01Q 1/246; H01Q 3/24; H01Q 3/26; H01Q 3/2617; H01Q 3/30; H01Q 3/34; H01Q 3/36; H01Q 3/38; H01Q 9/285; H01Q 13/085; H01Q 21/062; H01Q 21/064; H01Q 21/065; H01Q 21/22;
(Continued)

(56) References Cited

U.S. PATENT DOCUMENTS 9,001,917 B2 * 4/2015 Tzanidis ..... H04B 7/0456 375/259
9,570,809 B2 * 2/2017 Ganchrow ..... H01Q 9/285
(Continued)

*Primary Examiner* — Daniel Munoz
*Assistant Examiner* — Patrick R Holecek
(74) *Attorney, Agent, or Firm* — Womble Bond Dickinson (US) LLP

(57) ABSTRACT

An antenna system with a reconfigurable radiation pattern characteristic for the fifth generation (5G) mobile terminal is described, which includes multiple antenna sub-arrays with different radiation patterns and a switch that connects each antenna sub-array and controls switching between different antenna sub-arrays. A switch is disposed between the antenna sub-arrays and an RF front-end module. By switching between the different sub-arrays, the radiation in a desired direction can be selected. Therefore, the problem of the beam coverage and beam scanning blind spot of 5G terminal antenna in millimeter waveband can be solved effectively. Through expanding the scanning angle of the beam scanning, the scheme of 5G terminal antenna with a reconfigurable radiation pattern can be realized. The antenna structure of this disclosure makes full use of the space of the PCB board, and has the advantages of miniaturization, simple processing and compact structure, etc.

17 Claims, 27 Drawing Sheets

(51) Int. Cl.

| | |
|---|---|
| ***H01Q 25/00*** | (2006.01) |
| ***H01Q 3/36*** | (2006.01) |
| ***H01Q 9/28*** | (2006.01) |
| ***H01Q 13/08*** | (2006.01) |

(52) U.S. Cl.
CPC ..... *H01Q 13/085* (2013.01); *H01Q 25/002* (2013.01)

(58) Field of Classification Search
CPC ..... H01Q 21/28; H01Q 21/29; H01Q 21/293; H01Q 25/002
See application file for complete search history.

(56) References Cited

U.S. PATENT DOCUMENTS

| | | | | |
|---|---|---|---|---|
| 10,135,149 | B2 * | 11/2018 | Zhou | H01Q 13/106 |
| 2017/0012359 | A1 * | 1/2017 | Jung | H01Q 3/30 |

* cited by examiner

5G TERMINAL ANTENNA WITH RECONFIGURABLE RADIATION PATTERN

RELATED APPLICATIONS

This application claims the priority of Chinese patent application No. 201710261516.5, filed Apr. 20, 2017, which is incorporated by reference in its entirety.

FIELD OF THE DISCLOSURE

This disclosure relates generally to the technical field of antenna. More specifically, this disclosure relates to the mobile terminal antenna in 28 Gigahertz (GHz) with reconfigurable radiation pattern.

BACKGROUND

Recently, with the rapid development of wireless communication technology, the fourth generation (4G) network technology (up-link rate of 20 megabits per second (Mbit/s) and down-link rate of 100 Mbit/s) is basically able to meet the needs of a variety of mobile communications services. However, with the rapid development of mobile Internet technology and Internet of things technology, it almost subverts the traditional mobile communication business models. These emerging mobile communication services have provided new demands for the development of mobile communication networks, such as high traffic density, mass connections and ultra-low latency, which have led to the research and development of fifth generation (5G) communication technology. At present, the standardization of 5G mobile communication technology is gradually completed, and the equipment using 5G technology will also be gradually commercial around 2020. The data services of Giga-bit level in 5G will give users a totally new experience.

Through using the millimeter (mm) wave antenna, the problem of narrow bandwidth is solved. Through using the antenna array and beamforming technologies, the problem of attenuation of free space in millimeter wave band is solved. However, the problem of radiation direction in the 5G antenna is still existed. A typical radiation pattern of a 4G antenna which is an omnidirectional antenna. The radiation pattern is approximately circular in the horizontal direction, so it can achieve a full signal coverage of free space in horizontal direction with appropriate gain. A typical radiation pattern of a 5G antenna which is a directional antenna. The signal can only be transmitted and received in specified direction range pointed by terminal antenna. Even if the beam scanning is realized by phase shifter, it can only extend the signal radiation range in the lateral direction of radiation pattern of antenna array, and other directions remain blind spots of signal radiation, therefore it is difficult to achieve omnidirectional radiation characteristic of 4G antennas.

SUMMARY

In view of this, the technical problem to be solved of this disclosure is to provide an antenna array with different radiation patterns through switching between different sub-arrays, therefore the 5G terminal antenna with a reconfigurable radiation pattern can be realized.

In order to solve the above technical problems, the technical scheme provided by this disclosure is a 5G terminal antenna with a reconfigurable radiation pattern, which includes two or more antenna sub-arrays with different radiation patterns and a switch that is connected with each antenna sub-array and controls the switching between the different antenna sub-arrays.

This disclosure relates to a 5G terminal antenna in 28 GHz with a reconfigurable radiation pattern. A switching scheme is achieved by switching between two or more different antenna sub-arrays. The different sub-arrays have different radiation patterns with a certain angle, the radiation pattern of the different angles can be realized by switching between the different sub-arrays. By switching between the different sub-arrays, the radiation pattern in the desired directions can be selected, and the signal coverage in hemispherical space over the mobile terminal can be realized.

The described switch can be one of the following low loss switch: a single-pole-double-throw (SPDT) switch, a double-pole-double-throw (DPDT) switch, a single-pole-three-throw (SP3T) switch or a single-pole-three-throw (DP3T) switch, and so on.

Preferably, the two different antenna sub-arrays intersect each other. The antenna array has the advantages of simple structure and small size, and can be positioned at the top, the bottom, the left and the right sides of the hand-held mobile terminal device.

Preferably, the described switch is disposed between the antenna sub-arrays and a radio frequency (RF) frontend module. By accessing the RF frontend module, the antenna array can be used as a transmitting antenna or as a signal receiving antenna within the range of RF signal coverage.

Preferably, the RF frontend module includes a phase shifter. One end of the phase shifter is connected with the signal input port, and the other end is connected with the switch through a transceiver module. A phased array antenna with beam scanning can be formed by using phase shifters. Through changing the amplitude and phase of each antenna element, the beam scanning of each antenna sub-array can be realized. Each antenna sub-array itself can scan from −90 degrees to +90 degrees (Theta planes).

Preferably, the antenna array is composed of a plurality of antenna elements. The antenna element can be one or more of a slot antenna, an electric dipole antenna or a patch antenna. An antenna sub-array is composed of the above mentioned antenna elements. The combination of the radiation patterns of each antenna sub-arrays forms the signal coverage in hemispherical space over the 5G mobile terminal. Considering the radiation pattern after switching which need to realize the signal coverage in hemispherical space over the 5G mobile terminal, in the case of setting two antenna sub-arrays, at least one sub-array can achieve bidirectional radiation. In the case of setting three antenna sub-arrays, each antenna sub-array need to have a better beam width in the specified directions. In the case of setting two antenna sub-arrays, one antenna sub-array need to have a broadside radiation pattern on the top and bottom of the mobile terminal main board and another antenna sub-arrays need to have an end-fire radiation pattern on the end surface of the mobile terminal main board. Through switching between two different antenna sub-arrays, the switching between different radiation patterns can be realized, therefore the reconfigurable radiation pattern of the 5G terminal antenna is realized.

The combination of a slot antenna and an electric dipole antenna has the advantages of simple structure, small size and is convenient to the integrated at the end of the mobile terminal main board. The antenna array consisting of several T slot antenna elements has a bilateral radiation pattern on the top and bottom of the mobile terminal main board. The antenna array consisting of several electric dipole antenna elements has an end-fire radiation pattern at the end surface of the mobile terminal main board. Through switching between two different antenna sub-arrays, the switching between different radiation patterns can be realized, therefore the reconfigurable radiation pattern of the 5G terminal antenna is realized. By switching between the different sub-arrays, the radiation in the desired directions can be selected. Therefore, the problem of the narrow beam coverage of the 5G terminal antenna in millimeter wave band can be solved effectively. So the beam scanning angle can be expanded by combining beam scanning and other methods.

Preferably, the patch antenna includes a printed circuit board (PCB) substrate. A metal sheet is disposed on the top of the PCB substrate and a reference ground is disposed on the bottom of the PCB substrate. The patch antenna also includes a coaxial probe. An inner core at one end of the coaxial probe is connected with the metal sheet, and the other end of the coaxial probe passes through the PCB substrate and serves as a feed point.

As one of the implementation methods, three microstrip patch antenna sub-arrays are arranged on three different planes on the upper, lower and the end of the main board and the signal coverage of the antenna array in three directions is achieved respectively. Through switching between three antenna sub-arrays on different planes, the switching between the upper, lower and the end of the main board can be realized, therefore the reconfigurable radiation pattern of the 5G terminal antenna is realized.

Preferably, the described slot antenna can be one of a T-slot antenna, an I-slot antenna or a co-planar tapered slot antenna. The slot antenna is used to form a bilateral radiation pattern on the top and bottom of the mobile terminal main board.

Preferably, when the slot antenna is a T-slot antenna, which includes a PCB substrate. A metal copper foil is disposed on the top and bottom of the PCB substrate respectively. A T-slot is opened on the metal copper foil. A metal strip is located in the longitudinal gap of the T-slot on the top of the PCB substrate. A feed point is located at the lower end of the metal strip. Several metal vias are evenly distributed around the T-slot on the PCB substrate.

When the slot antenna is an I-slot antenna, which includes a PCB substrate. A metal I-slot passes through the PCB substrate. A metal layer on the PCB substrate is connected with the inner copper plating layer of the metal I-slot. A coaxial probe is used to feed the I-slot and is located in the width direction of the metal I-slot.

When the slot antenna is a co-planar slot antenna, which includes a PCB substrate. A metal copper foil is disposed on the top and bottom of the PCB substrate respectively. Two co-planar tapered slot are opened symmetrically on the metal copper foil. The co-planar slot includes an I-slot, a tapered slot and a rectangular slot. A co-planar waveguide feeder line is located at the symmetrical axis of the co-planar tapered slot and a feed point is located at the end of the co-planar waveguide feeder line.

Preferably, an electric dipole antenna includes an upper conductive module and a lower conductive module. A two-layer substrate is located between the upper conductive module and the lower conductive module. A feeder line is located in the middle of the two-layer substrate. The upper conductive module is connected with the feeder line through a metal via and the lower conductive module is connected with the reference ground.

Preferably, an electric dipole antenna can be one of a surface mount technology (SMT) electric dipole antenna, a printed electric dipole antenna or a metal via electric dipole antenna. The electric dipole antenna has an end-fire radiation pattern at the end surface of the mobile terminal main board.

When the electric dipole antenna is an SMT electric dipole antenna, which includes a symmetrically set of metal block 1 and metal block 2. A metal sheet 1 and a metal sheet 2 are respectively arranged on the opposite surfaces of the metal block 1 and the metal block 2. A two-layer substrate is located between the metal block 1 and the metal block 2. A feeder line is in the middle of the two-layer substrate. The metal sheet 1 is connected with the feeder line through the metal vias 191 and the metal sheet 1 is connected with the reference ground.

When the electric dipole antenna is a printed electric dipole antenna, which includes the first substrate, the second substrate, the third substrate and the fourth substrate. A metal sheet 1 is located at the side of the first substrate. A metal sheet 2 is located on the top of the second substrate and is connected with the metal sheet 1. A metal sheet 3 is located on the bottom of the third substrate. A metal sheet 4 is located at the side of the fourth substrate and is connected with the metal sheet 3. A feeder line is located between the second substrate and the third substrate. The metal sheet 2 is connected with the feeder line through the metal vias 191 and the metal sheet 3 is connected with the reference ground.

When the electric dipole antenna is a metal via electric dipole antenna, which includes the first substrate, the second substrate, the third substrate and the fourth substrate. A metal via 1 and a metal via 2 are located at edge of the first substrate and the fourth substrate respectively. A metal sheet 1 is located on the top of the metal via 1. A metal sheet 2 is located on the bottom of the metal via 1 and is connected with the metal sheet 1 through the metal via 1. A metal sheet 3 is located on the top of the metal via 2. A metal sheet 4 is located on the bottom of the metal via 2 and is connected with the metal sheet 3 through the metal via 2. A feeder line is located between the second substrate and the third substrate. The metal sheet 2 is connected with the feeder line through the metal via 191 and the metal sheet 3 is connected with the reference ground.

There are basically two ways to increase the wireless transmission rate, one is to increase the spectrum efficiency, and the other is to increase the bandwidth of the spectrum, which is particularly more important. Compared with the 100 MHz spectral bandwidth in the band below 3 GHz, the millimeter wave band has the natural advantage of several GHz spectral bandwidth. However, the millimeter wave band attenuates greatly in the air, and the diffraction ability is weaker, so the gain requirement of the antenna is relatively higher. Therefore, this disclosure adopts an antenna array, and each antenna element has its own amplitude and phase. By effectively controlling the amplitude and phase of each antenna element, the emitted electromagnetic waves from each antenna element cancel or reinforce each other. The limited energy is concentrated to be transmitted in a beam, and the energy transmission density is obviously enhanced, which can compensate for the fast attenuation spectrum characteristic of the millimeter wave.

The 5G terminal antenna solves the problem of narrow band width by adopting the millimeter wave antenna. Through the antenna array and beam forming technology, the problem of fast attenuation is solved, and the beam scanning is realized by using phase shifters to control the phase of the antenna elements.

Compared with the existing technologies, this disclosure has the following advantages, this disclosure proposes an antenna system with a reconfigurable radiation pattern characteristic for the fifth generation (5G) mobile terminal, which includes two or more antenna sub-arrays. A switch is disposed between the plurality of antenna sub-arrays and the RF front-end module. By switching between the different sub-arrays, the radiation in the desired direction can be selected. Therefore, the problem of the beam coverage and beam scanning blind spot of 5G terminal antenna in millimeter wave band can be solved effectively. Through expanding the scanning angle of the beam scanning, the scheme of 5G terminal antenna with a reconfigurable radiation pattern can be realized. The antenna structure of this disclosure makes full use of the space of the PCB board, and has the advantages of miniaturization, simple processing and compact structure, etc.

BRIEF DESCRIPTION OF THE DRAWINGS

Embodiments of the invention are illustrated by way of example and not limitation in the figures of the accompanying drawings in which like references indicate similar elements.

DETAILED DESCRIPTION

In order to facilitate the understanding of technical personnel in the field, this disclosure will be described in further detail in conjunction with the accompanying drawings and embodiments.

Embodiment 1

Figure 1:
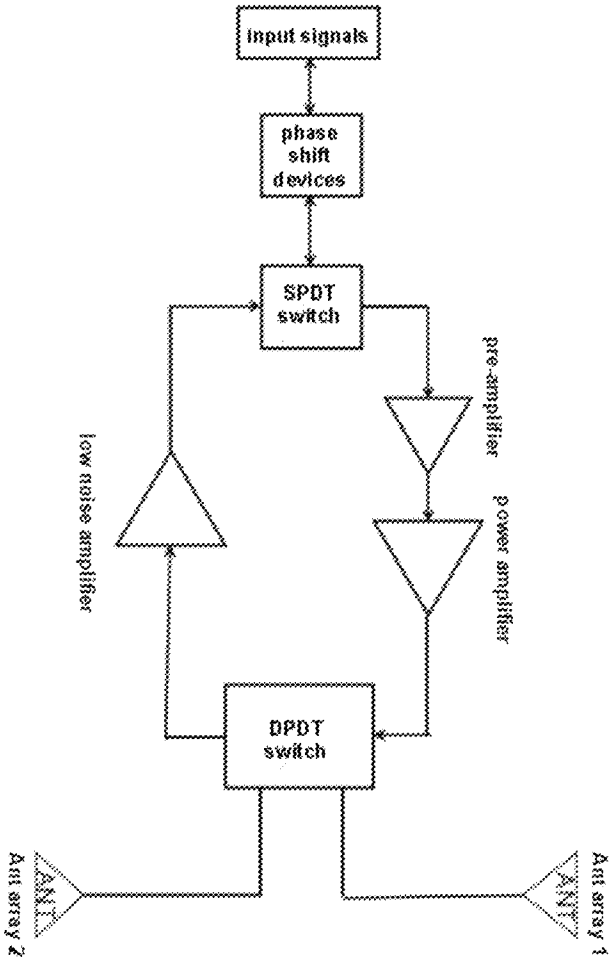
FIG. 1 is a structure schematic of the connection structure between the radio frequency front-end module and the antenna array in the embodiment 1 of the disclosure.

As shown in FIG. 1, a 5G terminal antenna with a reconfigurable radiation pattern includes two antenna sub-arrays. The two antenna sub-arrays are connected with the switch, which is a low loss DPDT switch. Through feeding the different antenna sub-arrays by switching, the switching between two antenna sub-arrays can be realized. The different antenna arrays have a different directional radiation patterns, and different antenna arrays can be switched to realize radiation patterns at different angles. So the signal coverage above the hemisphere of the 5G terminal antenna can be realized. The RF frontend module includes a phase shifter. One end of the phase shifter is connected with the signal input end port, and the other end is connected with the switch through a transceiver module. The transceiver module includes a switch, which connects two branches. One is a preamplifier and power amplifier, and the other is low-noise amplifier. The input signal controls the phase of the antenna elements by the phase shifters, so that the beam can be scanned in the horizontal direction. The amplitude of RF signal is increased by a dual amplifier, and the antenna array is fed through a low loss switch. The radiation in the desired directions can be selected. So the signal coverage above the hemisphere of the 5G terminal antenna can be realized. Similarly, the antenna array can also be used as a signal receiver within the coverage.

Figure 2:
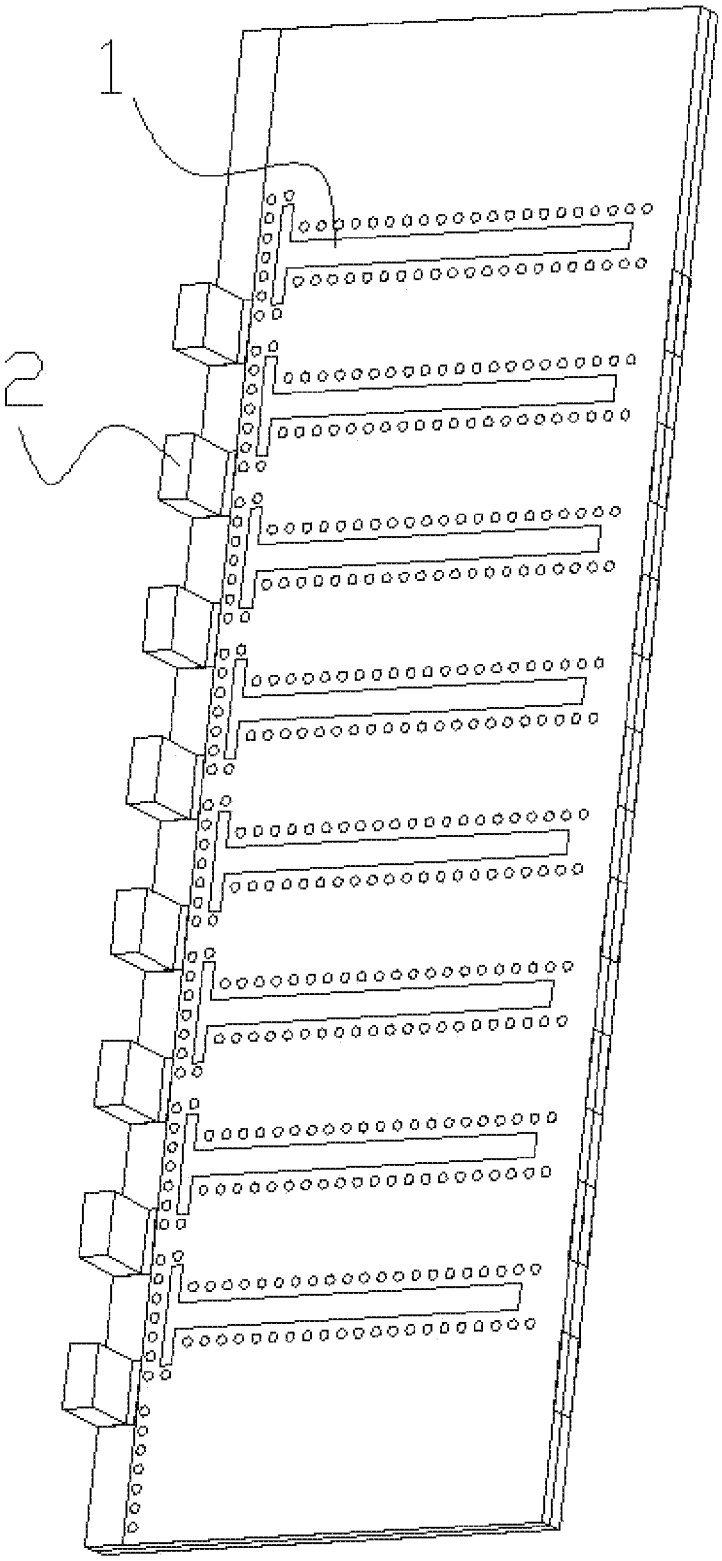
FIG. 2 is a back view structure schematic of an antenna array combining a T-slot antenna sub-array and an electric dipole antenna sub-array in the embodiment 1 of the disclosure.
Figure 3:
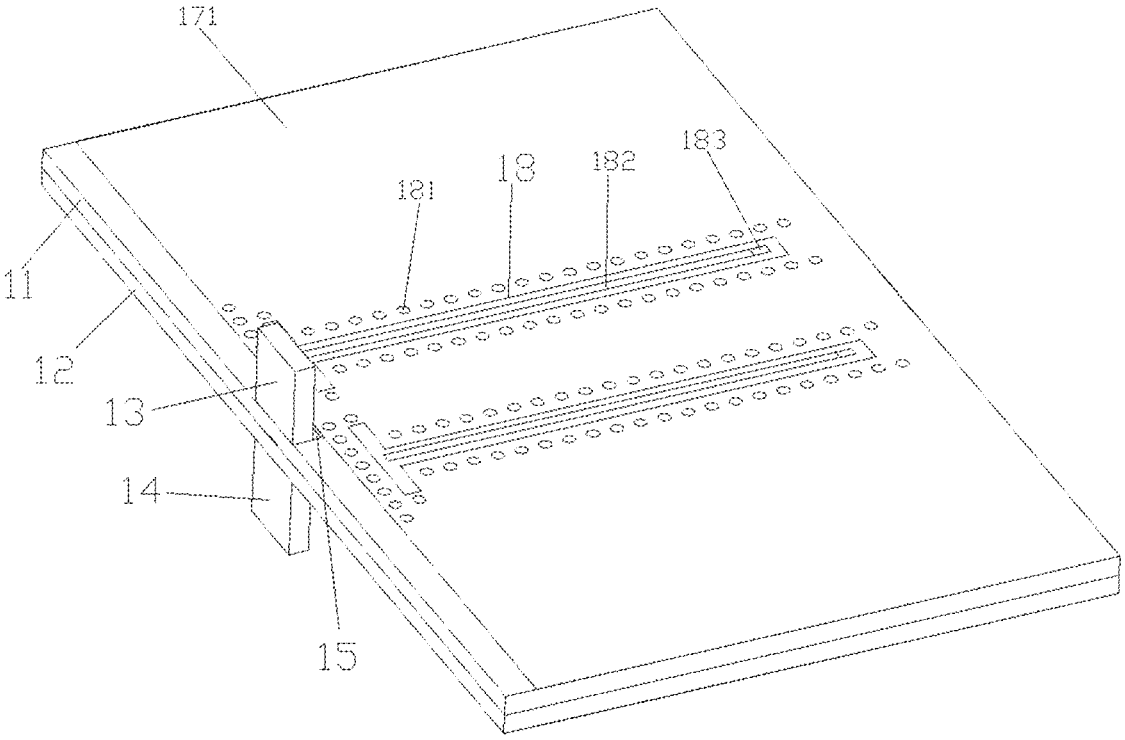
FIG. 3 is a structure schematic of the two antenna elements in the embodiment 1 of the disclosure.
Figure 4:
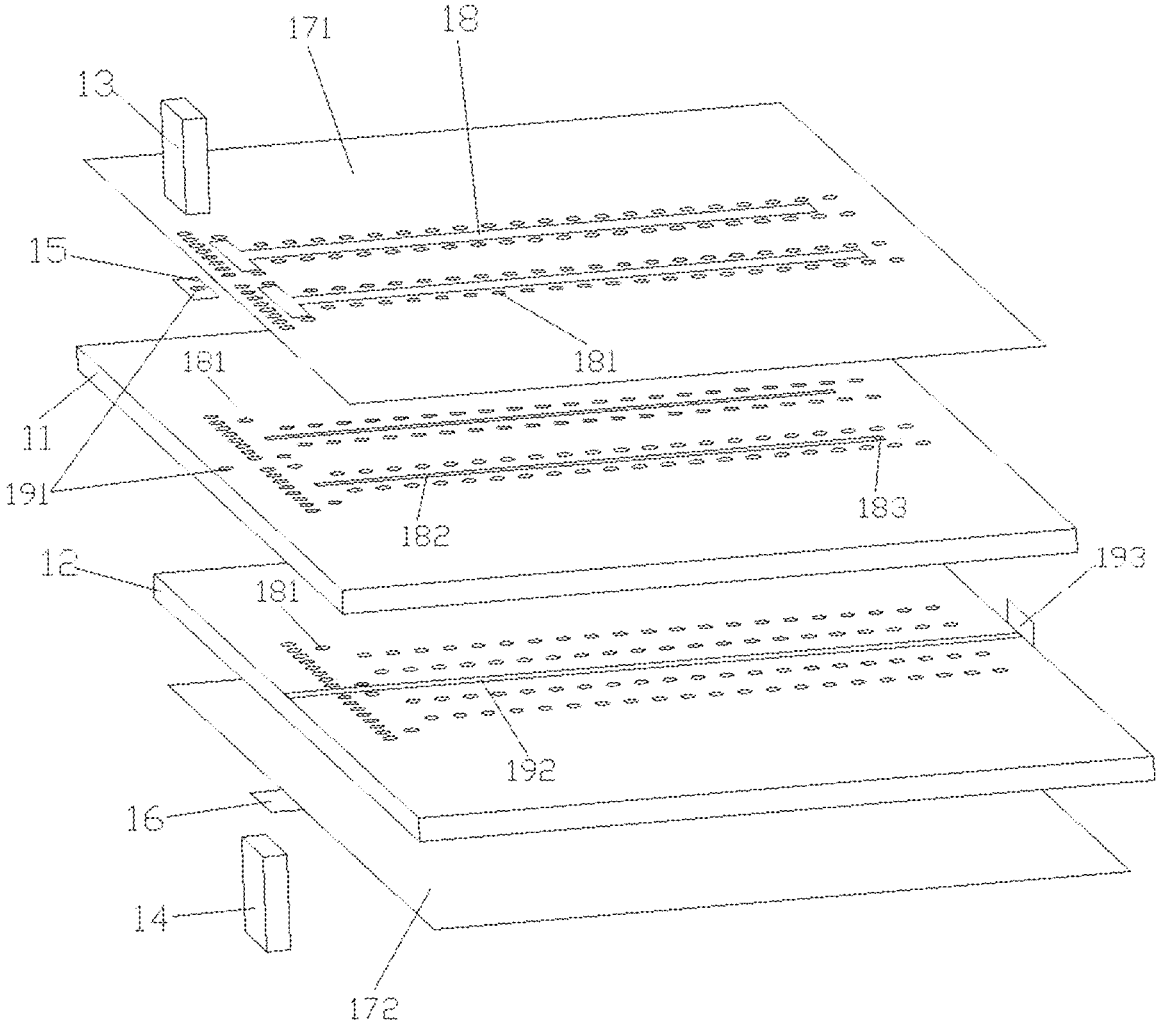
FIG. 4 is an explosive structure schematic of the two antenna elements in the embodiment 1 of the disclosure.
Figure 5:
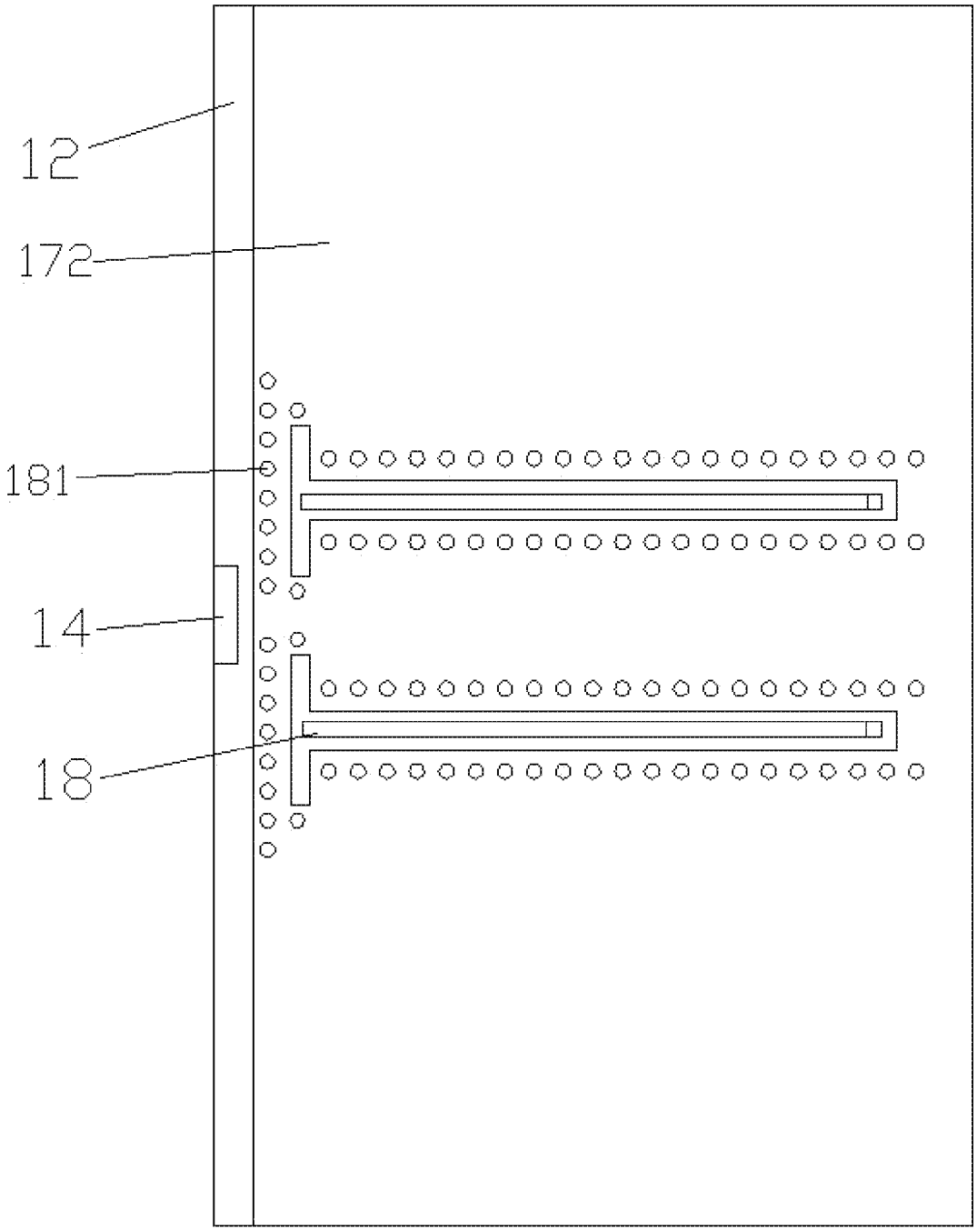
FIG. 5 is a front view structure schematic of the two antenna elements in the embodiment 1 of the disclosure.
Figure 6:
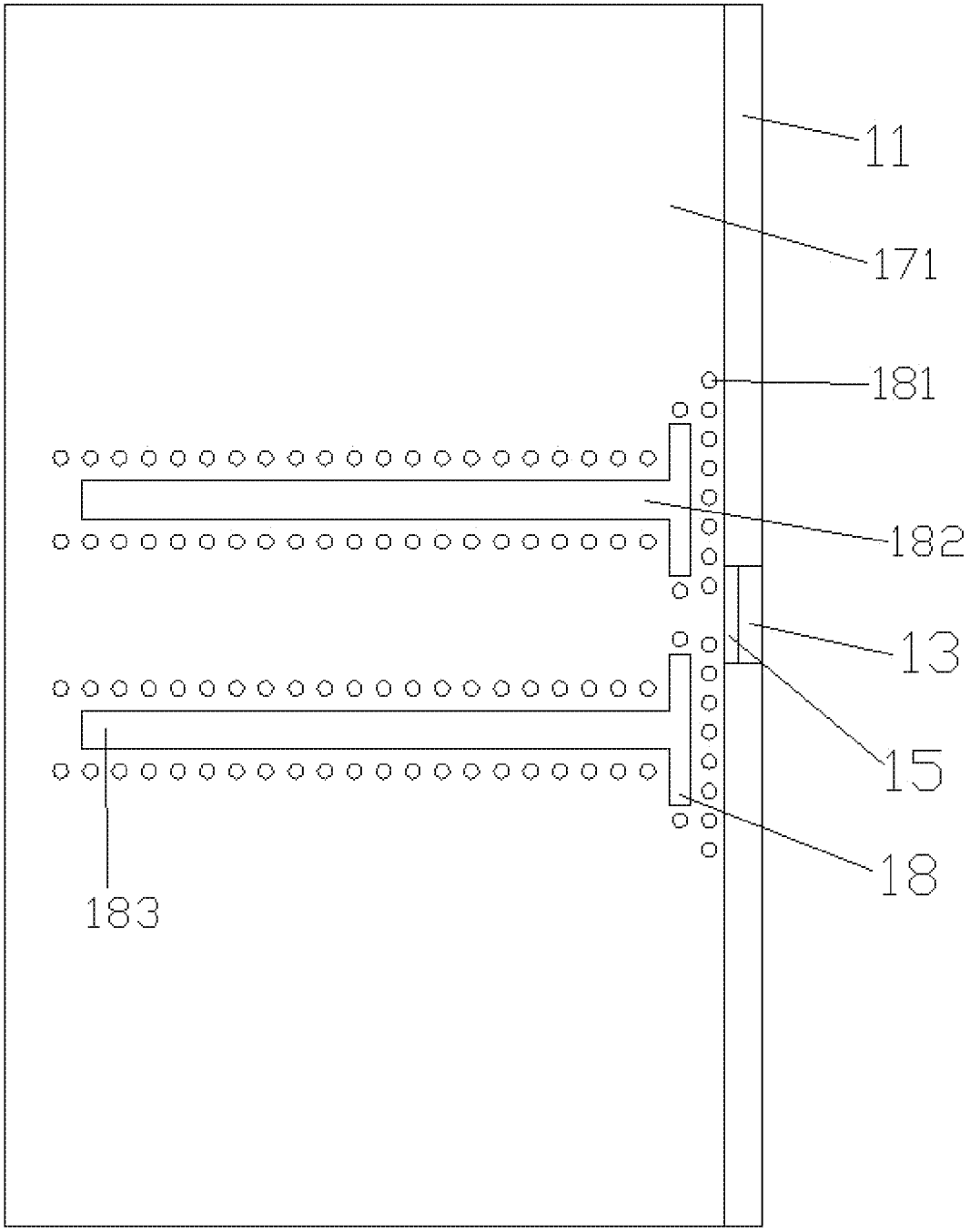
FIG. 6 is a back view structure schematic of the two antenna elements in the embodiment 1 of the disclosure.

As shown in FIG. 2, the two antenna sub-arrays are composed of a T-slot antenna sub-arrays 1 and electric dipole antenna sub-arrays 2. Each antenna sub-array consists of eight antenna elements. The eight antenna elements of two antenna sub-arrays intersect each other. The feed points of each antenna element are connected with the same feed network, and the low loss switch is connected with the feed network of each antenna sub-array.

As shown in FIGS. 3-6, this embodiment uses T-slot antenna elements and SMT electric dipole antenna elements to form two antenna sub-arrays, which include a two layer PCB substrate: the first substrate 11 and the second substrate 12. The metal copper foil 171 and the metal copper foil 172 are disposed on the top and bottom of the two layer PCB substrate respectively. A clearance area without a metal copper foil is disposed on the long side of the two layer substrate. The T-slot 18 which includes a transverse slot and a longitudinal slot is opened on the upper metal copper foil 171 and the lower metal copper foil 172. A metal strip 182 is located in the longitudinal slot of the T-slot 18. The width of the transverse slot and the distance between the metal strip 182 and the T-slot have a great influence on the resonance of the antenna. The antenna is fed by a metal strip 182 through a co-planar waveguide, and has a good radiation in the upper and lower directions of the two layer substrate. The first feed point 183 is located at the lower end of the metal strip 182. The resonance of the antenna can be tuned by adjusting the size of T-slot 18 and the distance between the metal strip 182 and the T-slot. Several metal vias 181 are evenly distributed around the T-slot 18. The metal vias 181 pass through the first substrate 11, the second substrate 12, the upper metal copper foil 171 and the lower metal copper foil 172. The metal vias 181 are connected with the upper metal copper foil 171 and the lower metal copper foil 172. The rectangle metal block 13 and the rectangle metal block 14 are symmetrically located on the upper and the lower edges of the two layer substrate. The rectangle metal sheet 15 is located between the rectangle metal block 13 and the top surface of the two layer substrate, and there is a gap between the rectangle metal sheet 15 and the upper metal copper foil 171. The rectangle metal sheet 16 is located between the rectangle metal block 14 and the bottom surface of the two layer substrate, which is connected with the lower metal copper foil 172. The upper metal copper foil 171 and the lower metal copper foil 172 are connected with the reference ground. The first metal block 13 and the second metal block 14 are welded together with the first metal sheet 15 and the second metal sheet 16 through the SMT process, which are located at the edge of the two layer substrate to form an electric dipole structure. A feeder line 192 is located in the middle of the two layer substrate. One end of the feeder line 192 is connected with the first metal sheet 15 through the metal vias 191, and the other end of the feeder line 192 is connected with the second feed point 193, therefore the direct feeding of the electric dipole is achieved.

The above mentioned two-layer substrate is a multiple layer laminated PCB substrate in the embodiment of this disclosure. Based on the comprehensive consideration of functionality and cost, a two layer laminated PCB substrate with permittivity of 4.4 is adopted. The thickness of PCB is 1 mm and the thickness of the first substrate 11 and the second substrate 12 is 0.5 mm respectively. A T-slot is opened on the metal copper layer on the top and bottom of the two layer laminated PCB substrate and is symmetrical with the metal strip 2. The metal vias 181 are evenly distributed around the T-slot. To ensure the continuity of the reference ground around the T-slot, the metal vias 181 pass through the two layer laminated PCB substrate and are connected with the upper metal copper foil 171 and the lower metal copper foil 172. The distance between the adjacent metal vias of the metal vias 181 should be less than a quarter of waveguide wavelength and the diameter of the metal vias should preferably be less than one eighth of waveguide wavelength.

Within the structure of the electric dipole antenna, the rectangular metal block 8 is located at the edge of the PCB substrates 4 and 5, and the long edge of the metal block 8 is along the length direction of the PCB substrates 4 and 5. The wide edge of the first metal block 13 is along the width direction of the two layer substrates and is parallel with the length direction of the feeder line 192. The first metal sheet 15 and the second metal sheet 16 are symmetrical with the feeder line 192. In order to facilitate SMT process and guarantee the solidity of the SMT, the size of the first metal block 13 shall be smaller than the size of the first metal sheet 15 and the second metal sheet 16. The first metal block 13 is located in the middle of the two T-slot antennas and there is a gap between the first metal block 13 and the transverse slot of the T-slot to reduce the mutual influence between the first metal block 13 and the T-slot antenna.

Figure 7:
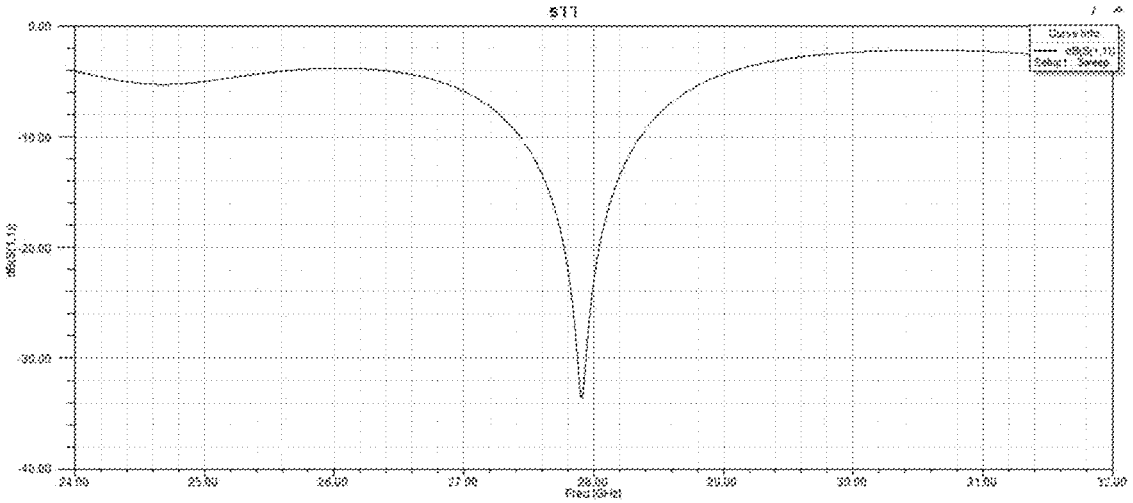
FIG. 7 is the return loss curve of the T-slot antenna element in the embodiment 1 of the disclosure.
Figure 8:
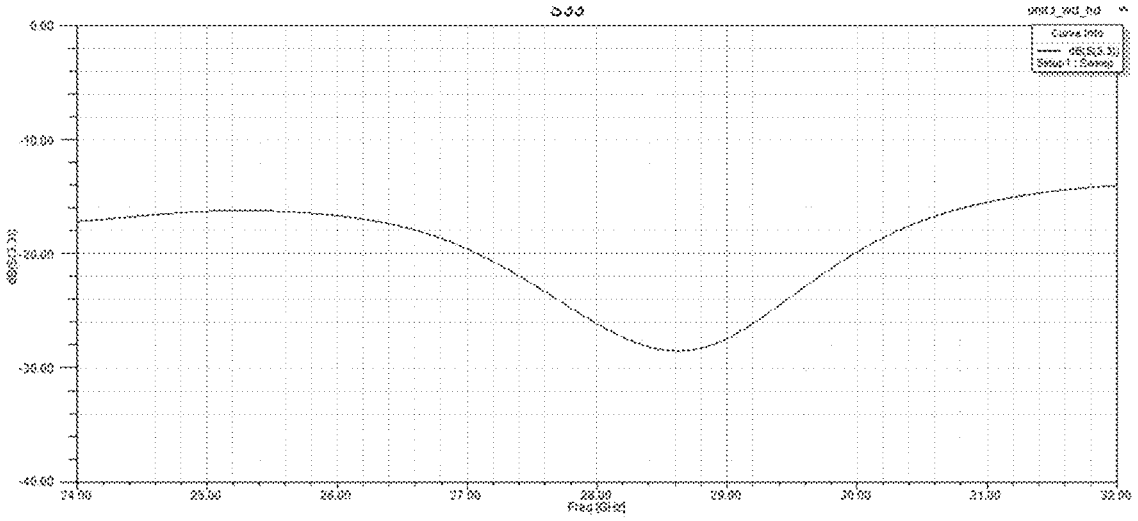
FIG. 8 is the return loss curve of the electric dipole antenna element in the embodiment 1 of the disclosure.
Figure 9:
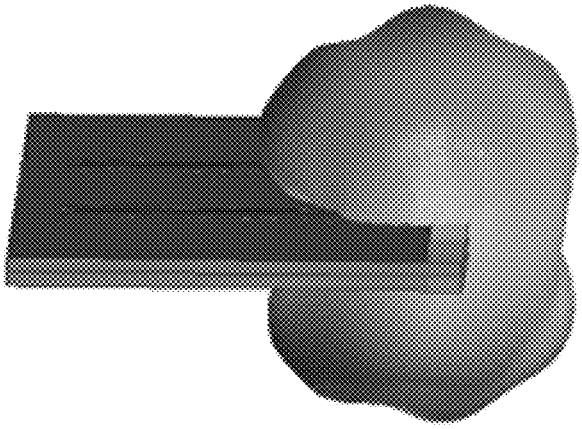
FIG. 9 is the radiation pattern of the T-slot antenna element in the embodiment 1 of the disclosure.
Figure 10:
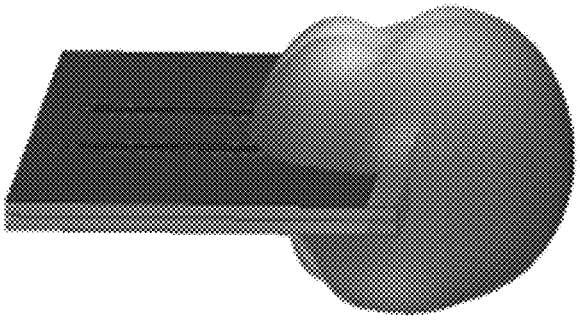
FIG. 10 is the radiation pattern of the electric dipole antenna element in the embodiment 1 of the disclosure.
Figure 11:
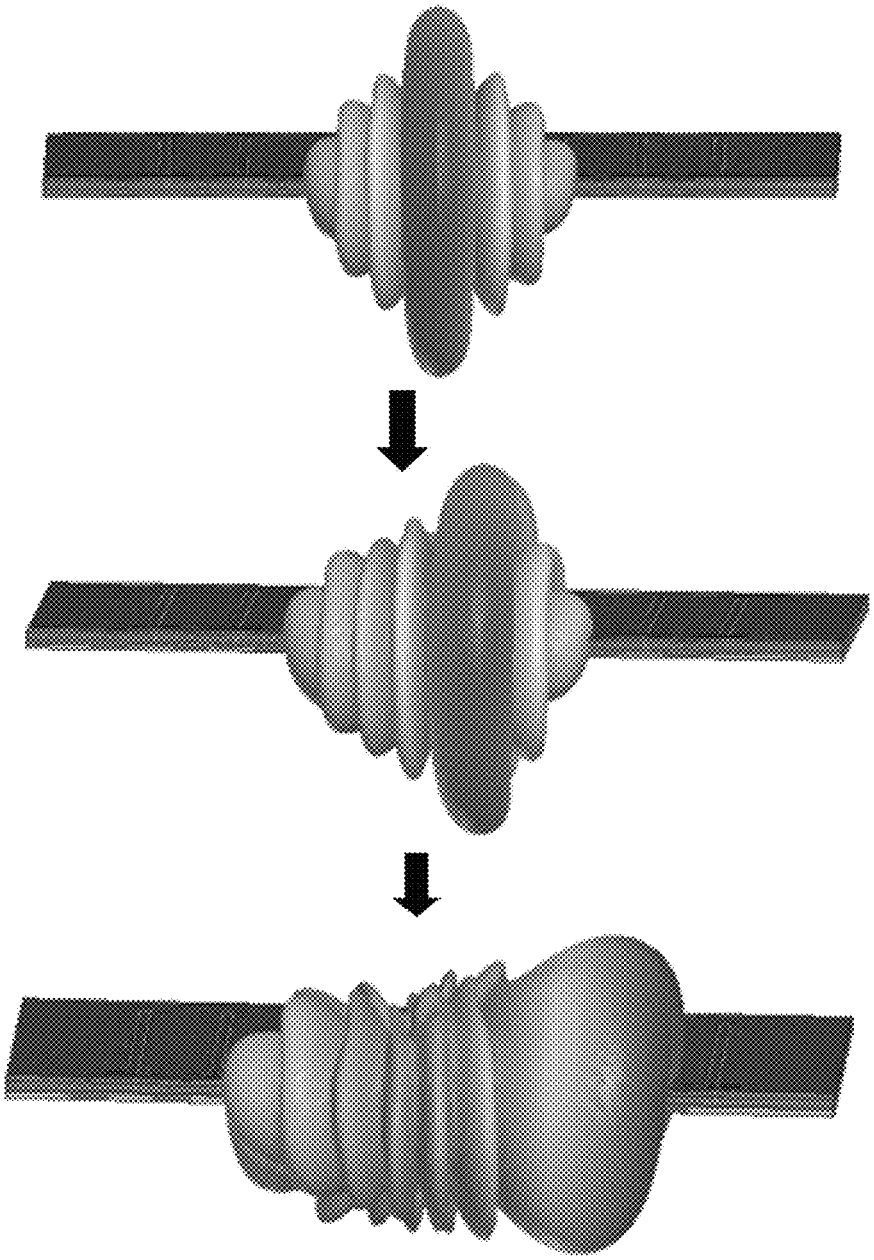
FIG. 11 is the radiation pattern of the electric dipole antenna sub-array with the different phase differences in the embodiment 1 of the disclosure.
Figure 12:
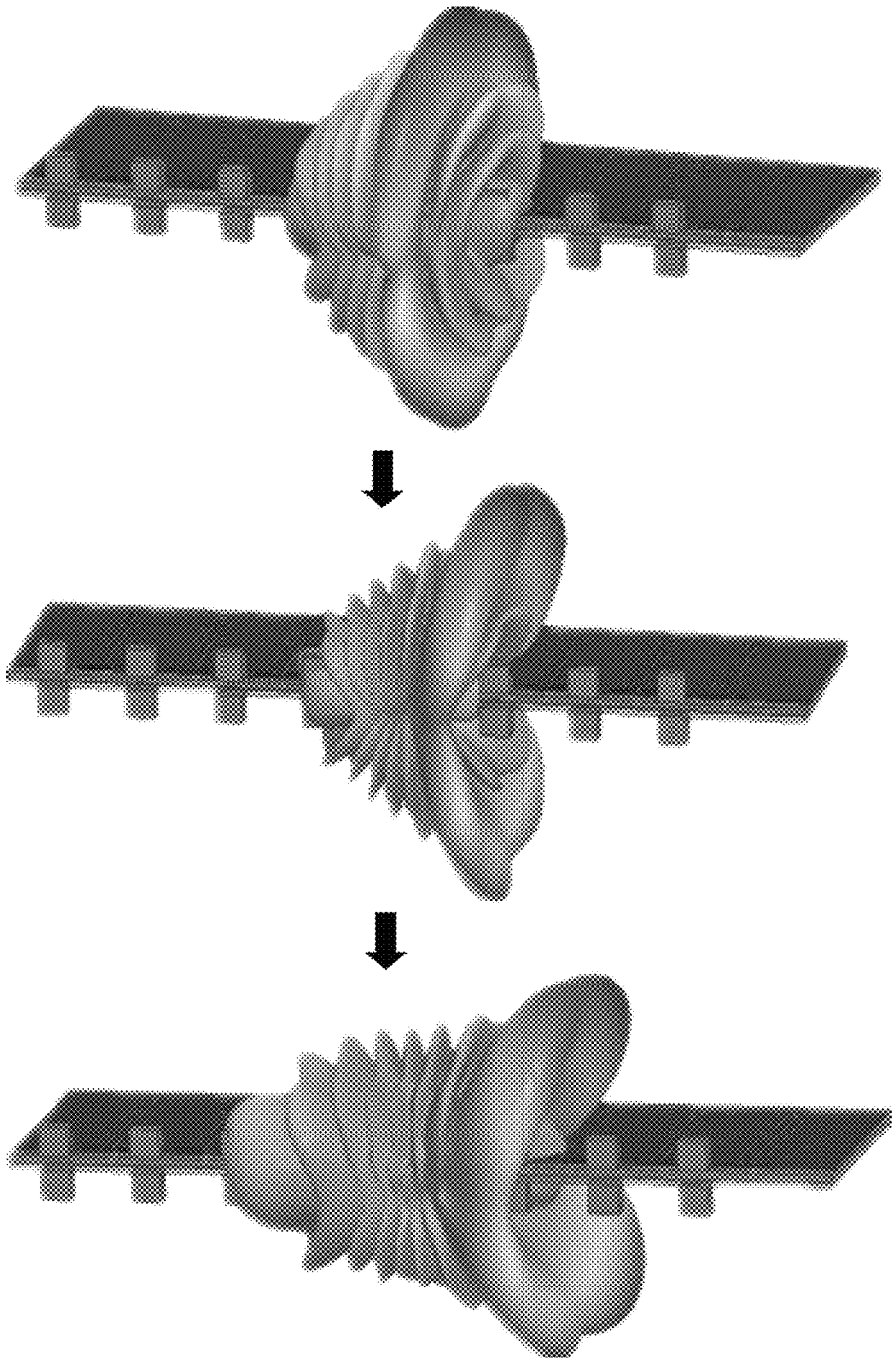
FIG. 12 is the radiation pattern of the T-slot antenna sub-array with the different phase differences in the embodiment 1 of the disclosure.

FIG. 7 illustrates a return loss curve of the T-slot antenna element. The antenna has a resonant at 28 GHz and the bandwidth of the antenna is about 1 GHz. FIG. 8 illustrates a return loss curve of the electric dipole antenna element. The antenna has a resonant at 28 GHz and has a relatively wide bandwidth. FIG. 9 illustrates the radiation pattern of the T-slot antenna element which has a good radiation pattern on the top and the bottom of the PCB substrate. FIG. 10 illustrates the radiation pattern of the electric dipole antenna element which has a good radiation pattern at the end surface of the PCB substrate. FIG. 11 illustrates a radiation pattern of the SMT electric dipole antenna array which has a good radiation pattern at the end surface of the PCB substrate. The beam is scanned in the transverse range by phase control. Through switching between the different sub-arrays by a low loss switch, the radiation in the desired directions can be selected. So the signal coverage above the hemisphere of the 5G terminal antenna can be realized. FIG. 12 illustrates a radiation pattern of the T-slot antenna sub-array with the different phase difference, which has a bilateral radiation pattern on the top and the bottom of the mobile terminal main board. The beam is scanned in the longitudinal range by phase control.

Embodiment 2

Figure 13:
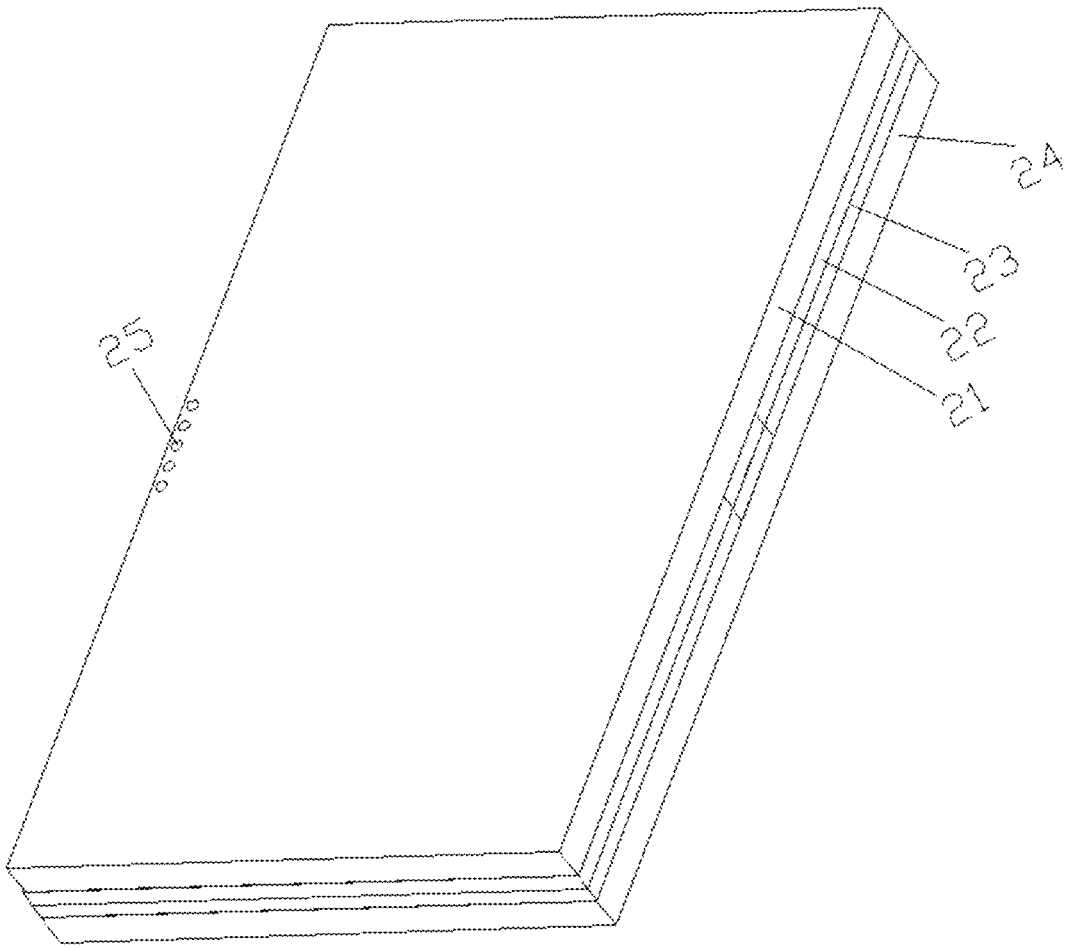
FIG. 13 is a structure schematic of the two antenna elements in the embodiment 2 of the disclosure.
Figure 14:
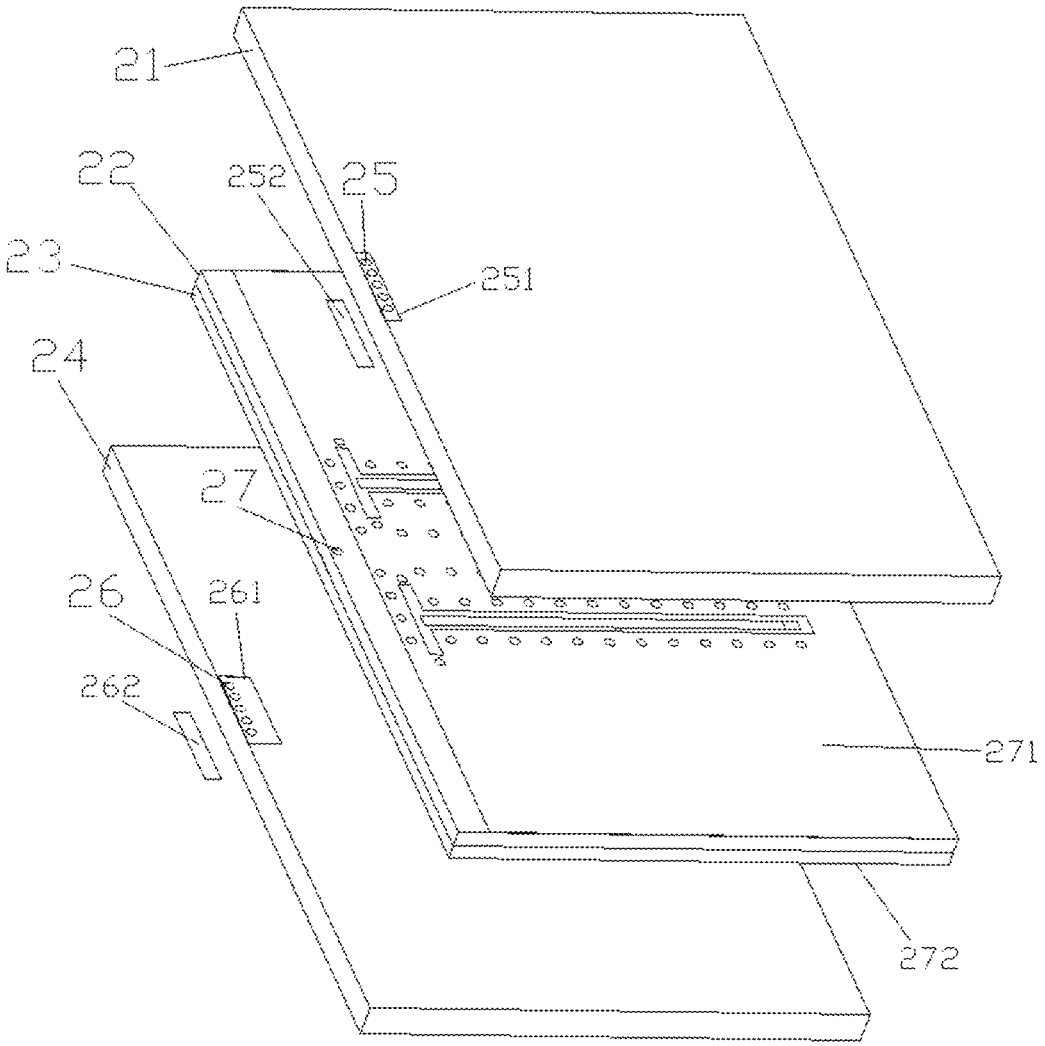
FIG. 14 is an explosive structure schematic of the two antenna elements in the embodiment 2 of the disclosure.

As shown in FIGS. 13-14, this embodiment differs from the embodiment 1. The antenna array consists of a T-slot antenna sub-array and a metal via electric dipole antenna sub-array. Through switching between two antenna subarrays which have different directional radiation patterns, the signal coverage above the hemisphere of the 5G terminal antenna can be realized.

The structure of the T-slot antenna in this embodiment is the same as embodiment 1. The electric dipole antenna of this embodiment adopts a metal via electric dipole antenna. The antenna array includes a four layer laminated PCB substrate: a first substrate 21, a second substrate 22, a third substrate 23, and a forth substrate 24. The T-slot is located at the second and the third layer of the four layer laminated PCB substrate. The T-slot is opened on the second and the third layer of the four layer laminated PCB substrate, and the T-slot antenna is fed by a co-planar waveguide (CPW). The electric dipole is composed of two rows of metal vias, which are punched in thickness direction of the first substrate 21 and the fourth substrate 24 of the four layer PCB substrate. The metal vias 25 and the metal vias 26 are disposed at the edges of the first substrate 21 and the fourth substrate 24 to form an electric dipole structure. The metal sheet 251 is located on the top of the metal vias 25. The metal sheet 252 is located on the bottom of the metal vias 25 and is connected with the metal sheet 251 through the metal vias 25. The metal sheet 261 is located on the top of the metal vias 26. The metal sheet 262 is located on the bottom of the metal vias 26 and is connected with the metal sheet 261 through the metal vias 26. The two layer substrate of the T-slot antenna includes the second substrate 22 and the third substrate 23, and same as embodiment 1, the feeder line is located between the second substrate 22 and the third substrate 23. The second metal sheet 252 is connected with the feeder line through the metal vias 27. Same as embodiment 1, the metal copper foil 271 is located on the top of the second substrate 22, and the metal copper foil 272 is located on the bottom of the third substrate 23. There is a gap between the second metal sheet 252 and the metal copper foil 271 on the top of the second substrate 22. The third metal sheet 261 is connected with the metal copper foil 272 on the bottom of the third substrate 23 and is also connected with the reference ground.

Embodiment 3

Figure 15:
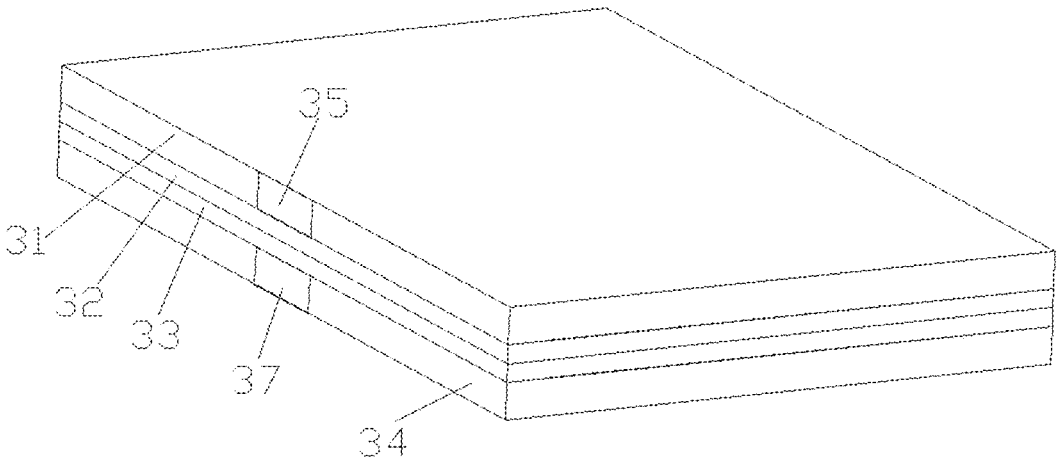
FIG. 15 is a structure schematic of the two antenna elements in the embodiment 3 of the disclosure.
Figure 16:
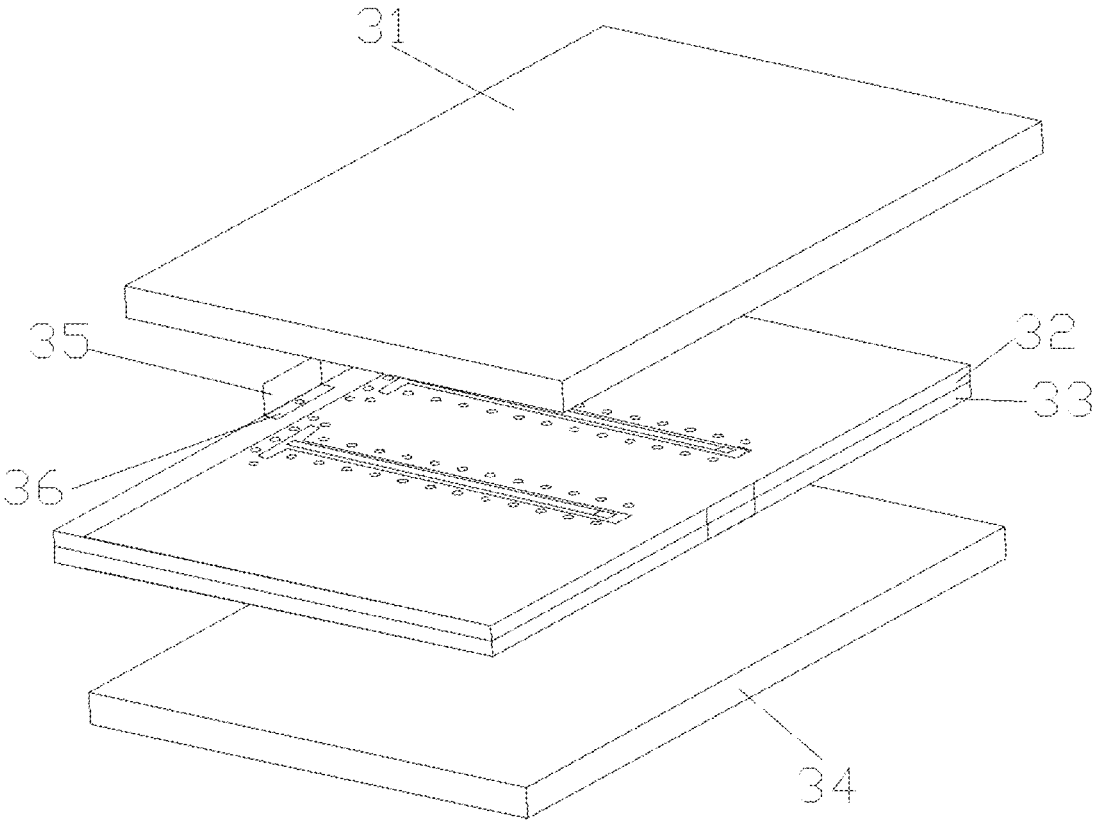
FIG. 16 is a front view explosive structure schematic of the two antenna elements in the embodiment 3 of the disclosure.
Figure 17:
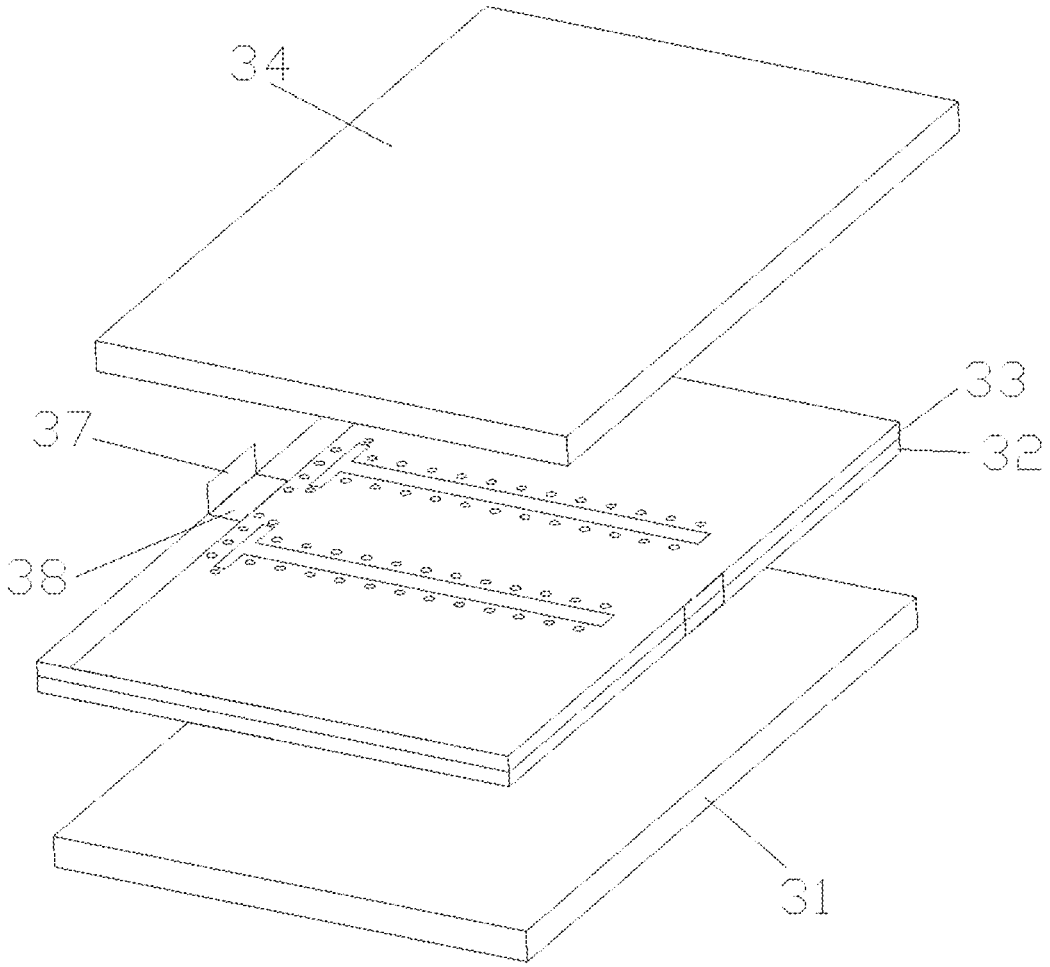
FIG. 17 is a back view explosive structure schematic of the two antenna elements in the embodiment 3 of the disclosure.

As shown in FIGS. 15-17, this embodiment differs from the embodiment 1. The antenna array consists of a T-slot antenna sub-array and a printed electric dipole antenna sub-array. Through switching between two antenna sub-arrays which have different directional radiation patterns, the signal coverage above the hemisphere of the 5G terminal antenna can be realized.

The structure of the T-slot antenna in this embodiment is the same as embodiment 1. The electric dipole antenna of this embodiment adopts a printed electric dipole antenna. The antenna array includes a four layer laminated PCB substrate: the first substrate 31, the second substrate 32, the third substrate 33 and the forth substrate 34. A T-slot is located at the second and the third layer of the four layer laminated PCB substrate. The T-slot is opened on the second and the third layer, and the T-slot antenna is fed by the CPW. The printed electric dipole is realized by attaching the metal sheet to the side of the thickness direction of the upper substrate and the lower substrate by adopting the PCB hemming process. The first metal sheet 35 is located at the side of the first substrate 31. The second metal sheet 36 is located at the upper edge of the second substrate 32 and is connected with the first metal sheet 35. The third metal sheet 38 is located at the lower edge of the third substrate 33. The forth metal sheet 37 is located at the side of the forth substrate 34 and is connected with the third metal sheet 37. There is a gap between the second metal sheet 36 and the metal copper foil on the second substrate 32. The third metal sheet 38 is connected with the metal copper foil on the third substrate 33. A feeder line is located between the second substrate 32 and the third substrate 33. The second metal sheet 36 is connected with the feeder line through the metal vias. The third metal sheet 38 is connected with the reference ground. The electric dipole consists of the first metal sheet 35, the second metal sheet 36, the third metal sheet 38, the forth metal sheet 37, the metal vias and the feeder line. The feeder line is located between the second substrate 32 and the third substrate 33. One end of the feeder line is connected with the metal vias, and the other end of the feeder line is connected with the feed point, therefore the direct feed of the electric dipole antenna is realized.

Embodiment 4

Figure 18:
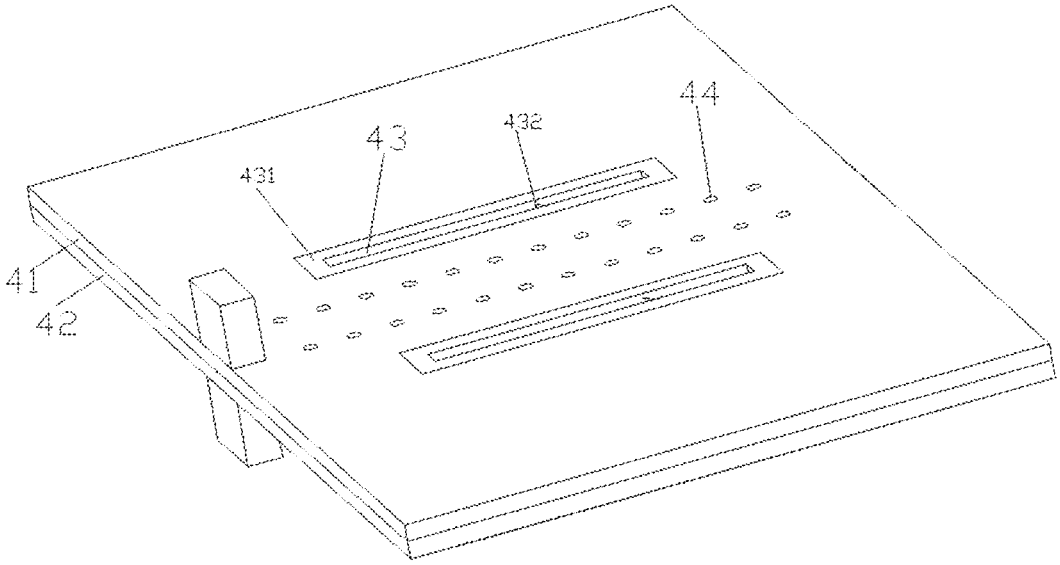
FIG. 18 is a structure schematic of the two antenna elements in the embodiment 4 of the disclosure.
Figure 19:
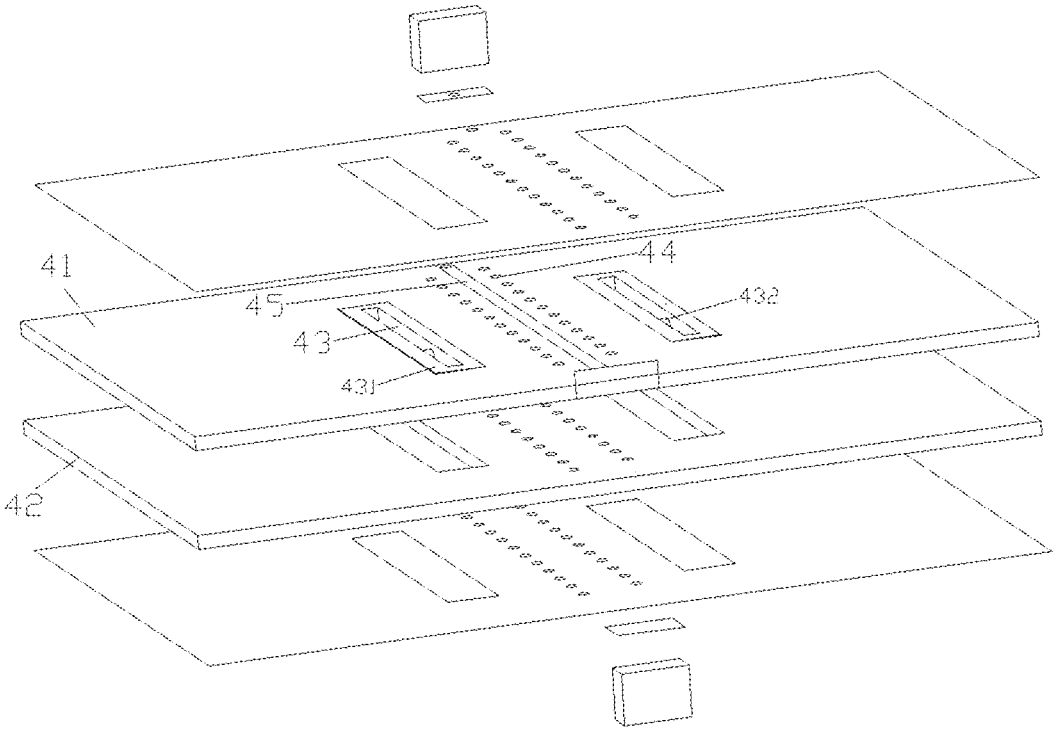
FIG. 19 is an explosive structure schematic of the two antenna elements in the embodiment 4 of the disclosure.

As shown in FIGS. 18-19, this embodiment differs from the embodiment 1. The antenna array consists of an I-slot antenna sub-array and an SMT electric dipole antenna sub-array. Through switching between two antenna sub-arrays which have different directional radiation patterns, the signal coverage above the hemisphere of the 5G terminal antenna can be realized.

This embodiment includes a two-layer substrate: a first substrate 41 and a second substrate 42. The structure of electric dipole antenna is basically the same as the embodiment 1. The difference is that the metal vias 44 are evenly distributed at the both sides of the feeder line 45. The metal vias are connected with the metal copper foil on the top and the bottom of the two layer PCB substrate. The slot antenna adopts an I-slot antenna in this embodiment. The I-slot 43 passes through the two layer substrate and the metal copper foil on the top and the bottom of the two layer substrate. The metal copper foil 431 is located around the I-slot 43 and is connected with the inner surface of the I-slot 43. The I-slot antenna is fed by the coaxial probe 432, which is located at the width direction of the I-slot. The I-slot 43 is filled by air.

Figure 20:
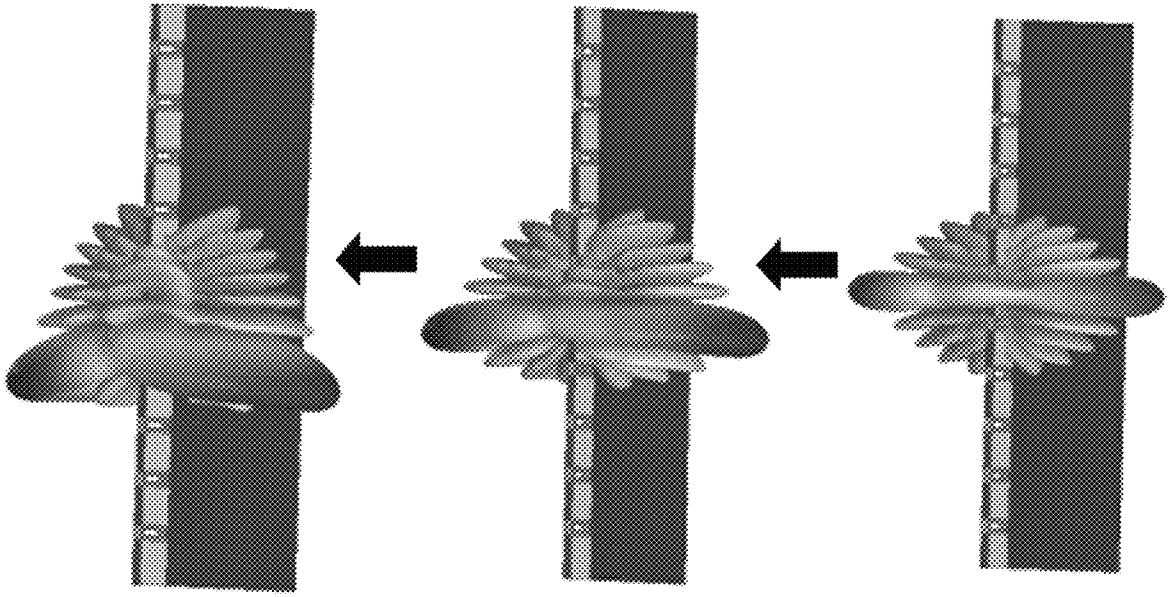
FIG. 20 is the radiation pattern of the I-slot antenna with air-filled in the embodiment 4 of the disclosure.

FIG. 20 illustrates a radiation pattern of the I-slot antenna with air-filled and has a bilateral radiation pattern on the top and bottom of the mobile terminal main board. The beam is scanned in the longitudinal range by phase control.

Embodiment 5

Figure 21:
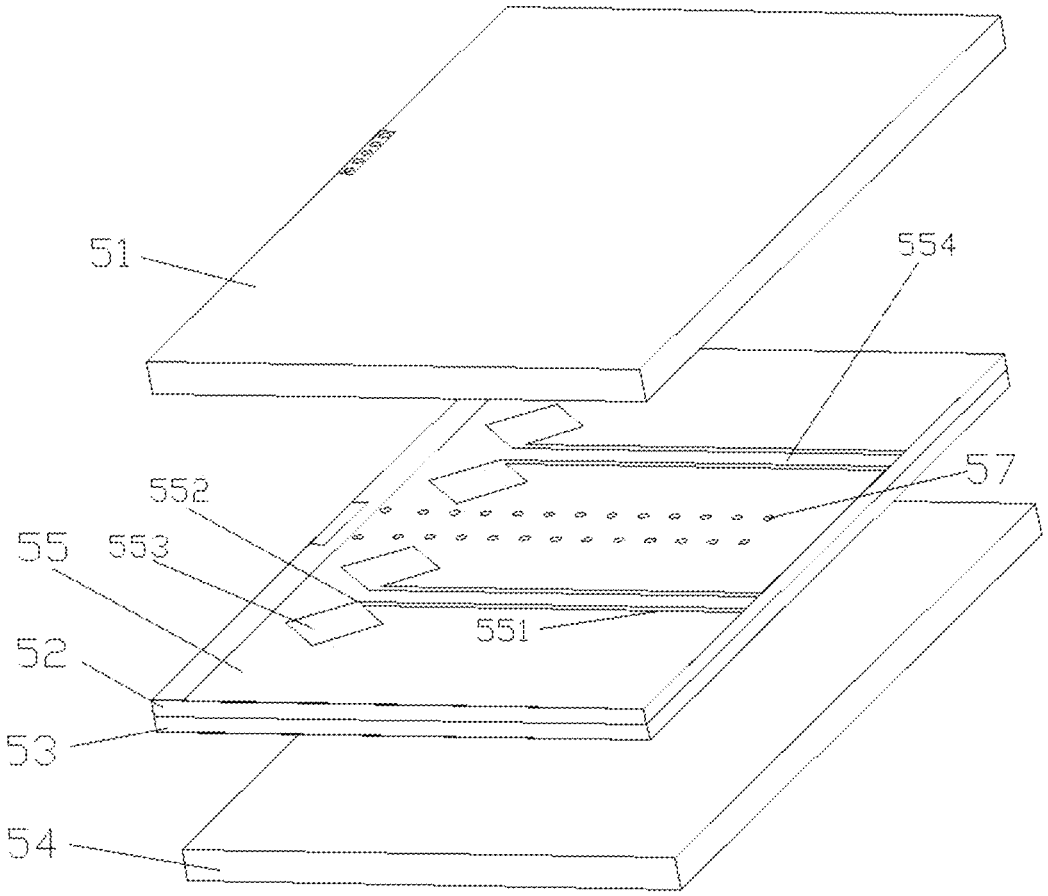
FIG. 21 is an explosive structure schematic of the two antenna elements in the embodiment 5 of the disclosure.
Figure 22:
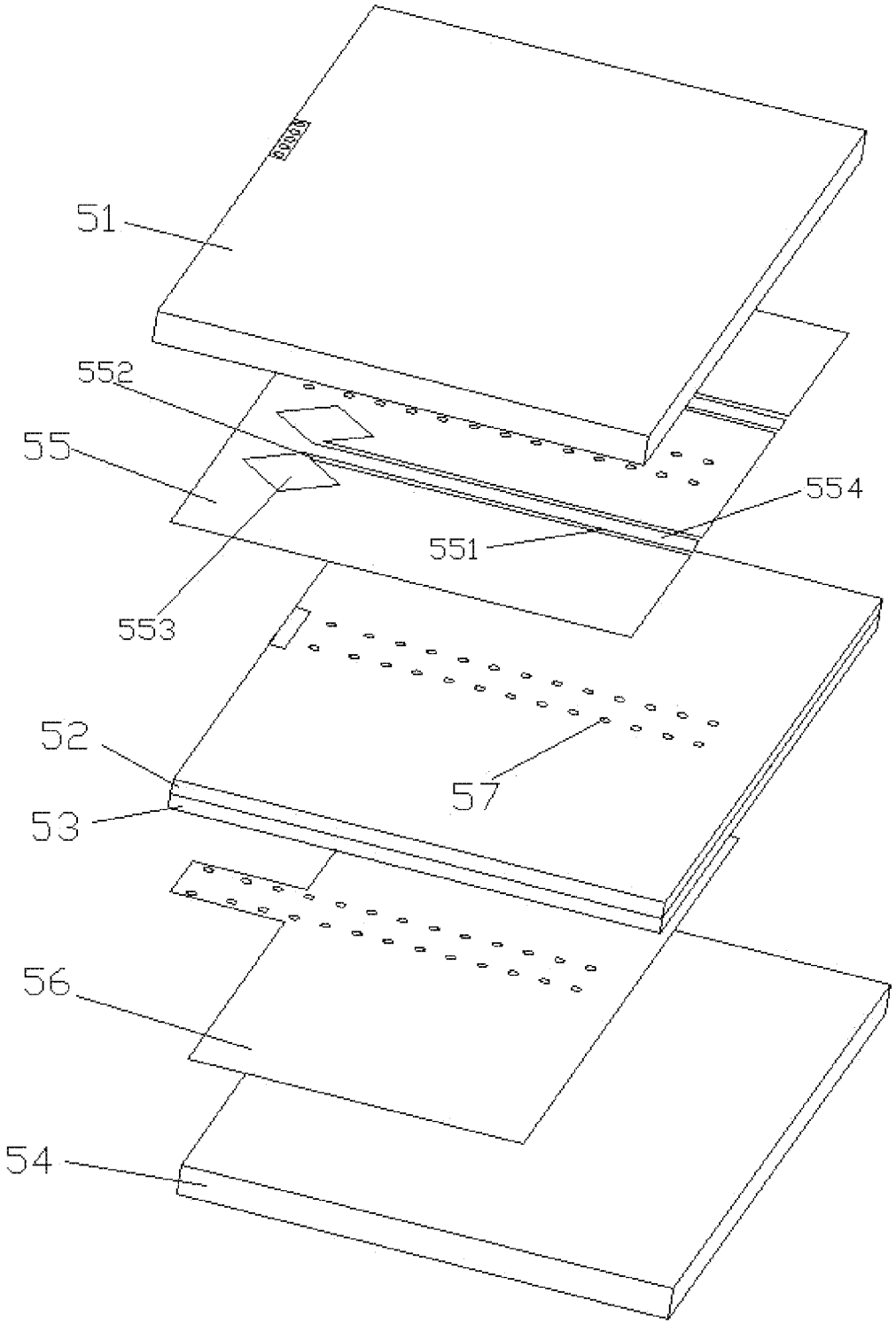
FIG. 22 is an explosive structure schematic of the two antenna elements in the embodiment 5 of the disclosure.

As shown in FIGS. 21-22, this embodiment differs from the embodiment 1. The antenna array consists a co-planar tapered slot antenna sub-array and a metal via electric dipole antenna sub-array. Through switching between two antenna sub-arrays which have different directional radiation patterns, the signal coverage above the hemisphere of the 5G terminal antenna can be realized.

This embodiment includes a four-layer substrate: a first substrate 51, a second substrate 52, a third substrate 53, and a forth substrate 54. The structure of the metal via electric dipole antenna is basically the same as the embodiment 2. The difference is that the metal vias 57 are evenly distributed at the both sides of the feeder line 45. The metal vias 57 is connected with the first metal copper foil 55 on the top of the second substrate 52 and the second metal copper foil 56 on the bottom of the third substrate 53. The metal vias 57 passes through the first metal copper foil 55, the second substrate 52, the third substrate 53 and the second metal copper foil 56. The feeder line is located between the second substrate 52 and the third substrate 53 (not shown in the figure and the structure is similar to the embodiment 2). The slot antenna adopts a co-planar tapered slot antenna, which is also called a complementary dipole antenna. Two symmetrical co-planar slot are opened on the first metal copper foil 55. The co-planar slot includes an I-slot 551, a tapered slot 552, and a rectangular slot 553. The CPW feeder line 554 is located at the symmetrical axis of two co-planar tapered slots. The feed point is located at the end of the CPW feeder line and the co-planar tapered slot is fed by the CPW. The corresponding region of the rectangular slot 553 on the second metal copper foil 56 is a clearance area.

Embodiment 6

Figure 23:
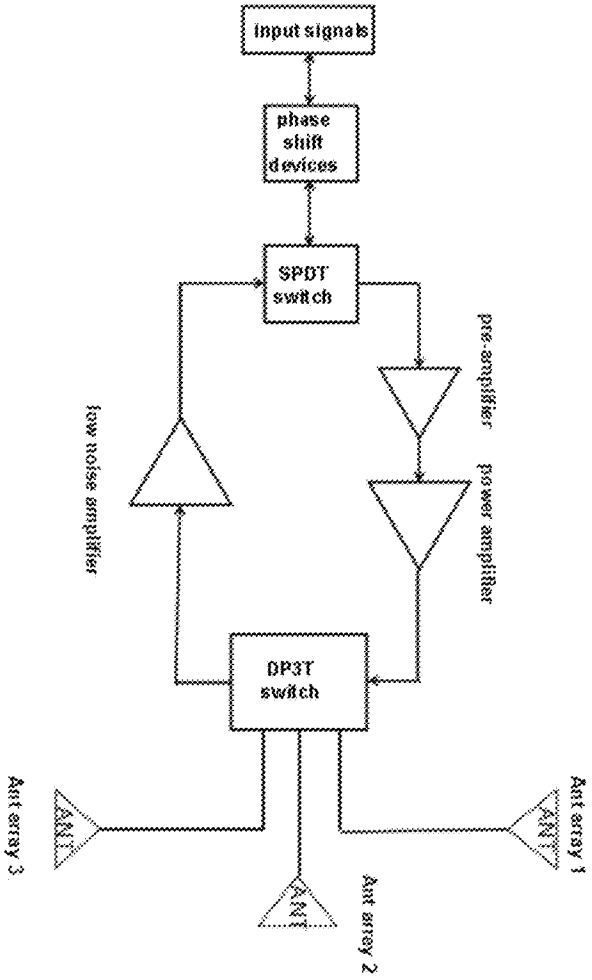
FIG. 23 is a structure schematic of the connection between the RF front-end module and the antenna array in the embodiment 6 of the disclosure.

As shown in FIG. 23, this embodiment differs from the embodiment 1. The antenna array consists three antenna sub-arrays. The three antenna sub-arrays are connected with a switch, which can be a low loss DP3T switch or a low loss SP3T switch. Through switching between two antenna sub-arrays which have different directional radiation patterns, the signal coverage above the hemisphere of the 5G terminal antenna can be realized. Similarly, three antenna sub-arrays is connected with the RF front-end module through a switch, and the structure of the RF front-end module is identical to embodiment 1. The input signal controls the phase of the antenna elements by the phase shifters, so that the beam can be scanned in the horizontal direction. The amplitude of RF signal is increased by a dual amplifier, and the antenna array is fed through a low loss switch. The radiation in the desired directions can be selected. So the signal coverage above the hemisphere of the 5G terminal antenna can be realized. Similarly, the antenna array can also be used as a signal receiver within the coverage.

Figure 24:
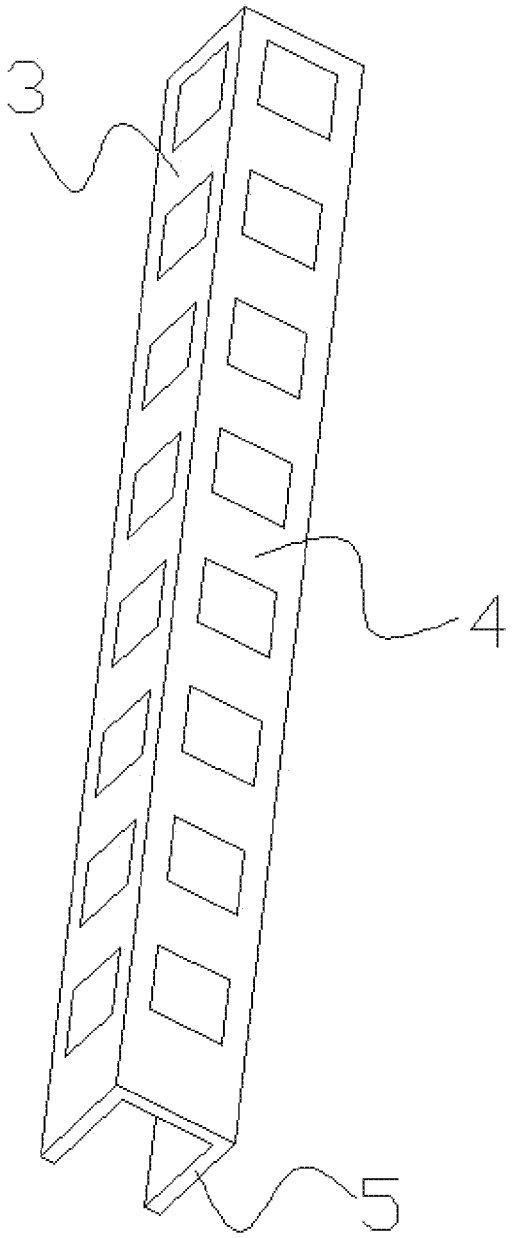
FIG. 24 is a structure schematic of three antenna sub-arrays in the embodiment 6 of the disclosure.
Figure 25:
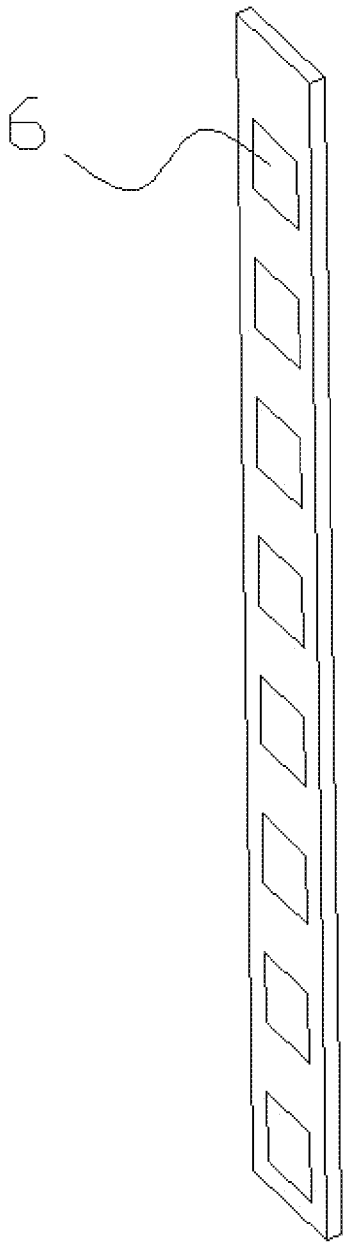
FIG. 25 is a structure schematic of one of three patch antenna sub-arrays in the embodiment 6 of the disclosure.
Figure 26:
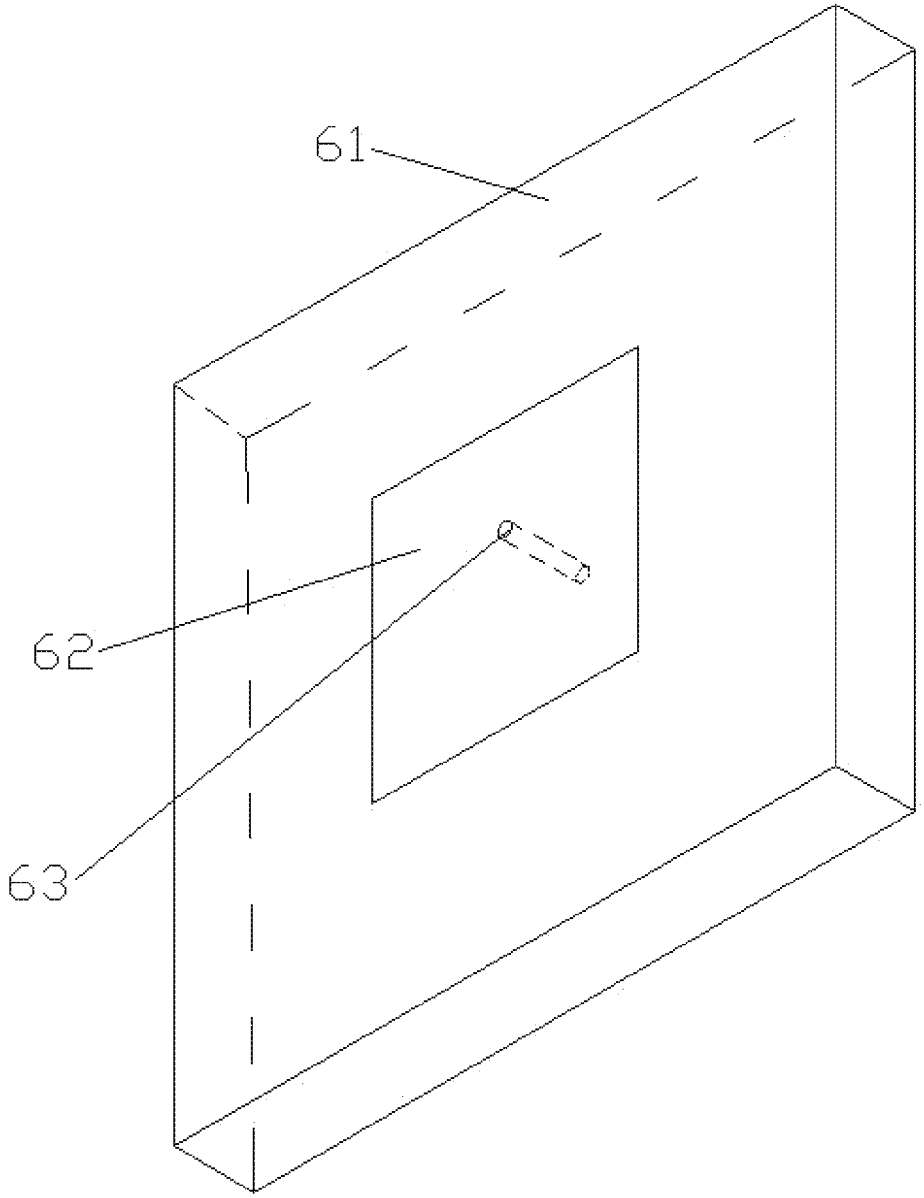
FIG. 26 is a structure schematic of a microstrip patch antenna element in the embodiment 6 of the disclosure.

As shown in FIG. 24, the three antenna sub-arrays are patch antenna arrays, which include a first antenna sub-array 3, a second antenna sub-array 4, and a third antenna sub-array 5. The long side of the first antenna array 3 is connected with the long side of the second antenna sub-array 4 and the two antenna sub-arrays are vertical. The other long side of the second antenna sub-array 4 is connected with the long side of the third antenna sub-array 5 and the two antenna sub-arrays are vertical. The antenna array has a small volume and can be disposed on the top, the end and the bottom of the mobile terminal. As shown in FIG. 25, each patch antenna sub-array consists of several patch antenna elements 6. There are 8 patch antenna elements 6 in this embodiment. As shown in FIG. 26, the patch antenna element 6 includes a substrate 61. The metal sheet 62 is located on the top of the substrate 61. A metal copper foil is disposed on the bottom of the substrate 61 as a reference ground. The patch antenna element also includes a coaxial probe 63. An inner core at one end of the coaxial probe is connected with the metal sheet 62, and the other end of the coaxial probe passes through the PCB substrate 61 and the metal copper foil and serves as a feed point.

Figure 27:
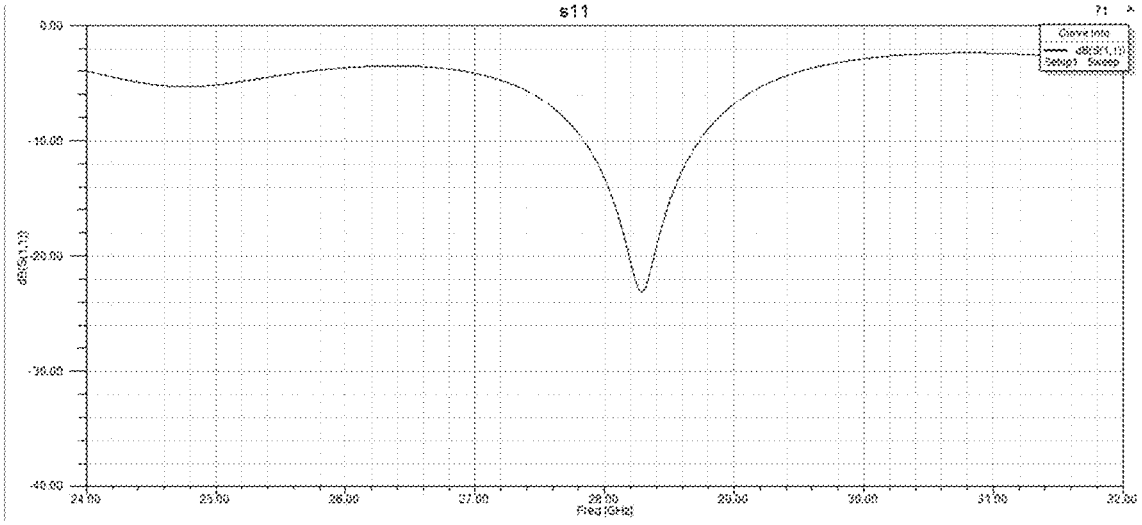
FIG. 27 is the return loss curve of the microstrip patch antenna element in the embodiment 6 of the disclosure.
Figure 28:
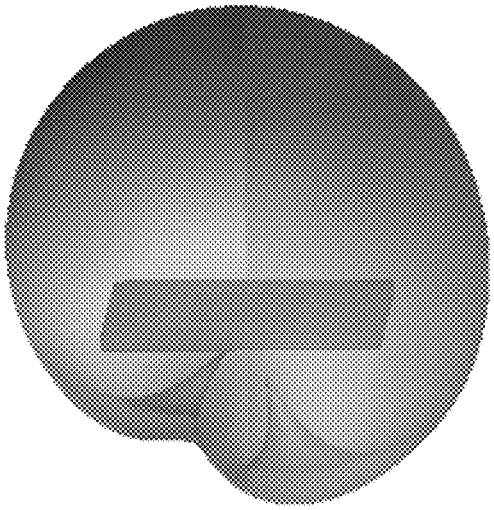
FIG. 28 is the radiation pattern of the microstrip patch antenna element in the embodiment 6 of the disclosure.
Figure 29:
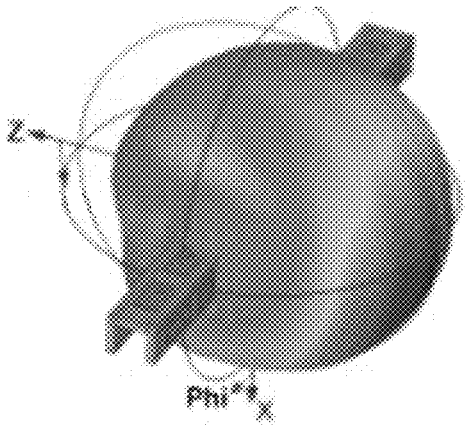
FIG. 29 is the radiation pattern of the microstrip patch antenna element on the upper plane of the mobile terminal main board of the disclosure.
Figure 30:
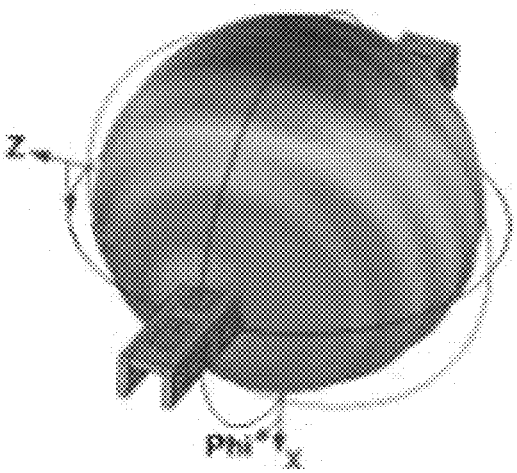
FIG. 30 is the radiation pattern of the microstrip patch antenna element at the end surface of the mobile terminal main board of the disclosure.
Figure 31:
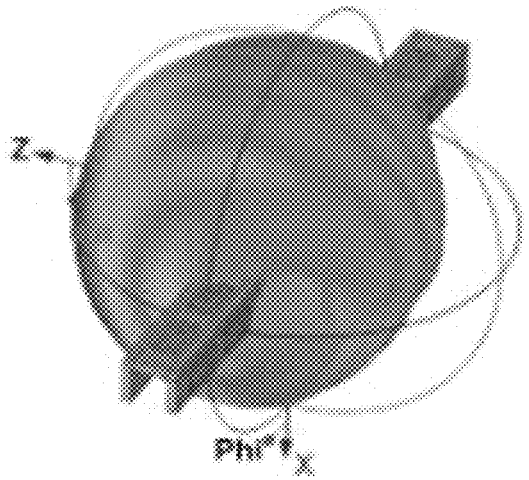
FIG. 31 is the radiation pattern of the microstrip patch antenna element on the lower plane of the mobile terminal main board of the disclosure.
Figure 32:
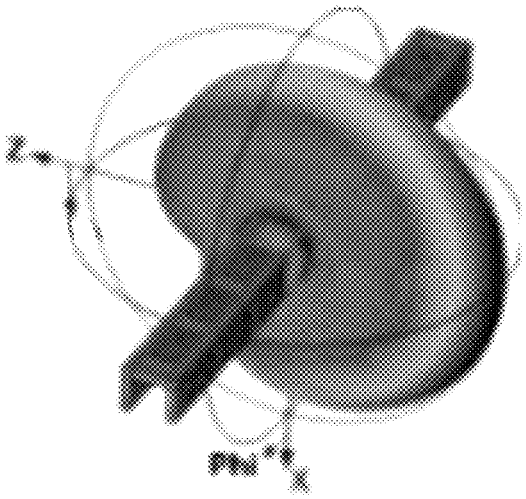
FIG. 32 is the radiation pattern of the microstrip patch antenna array on the upper plane of the mobile terminal main board of the disclosure.
Figure 33:
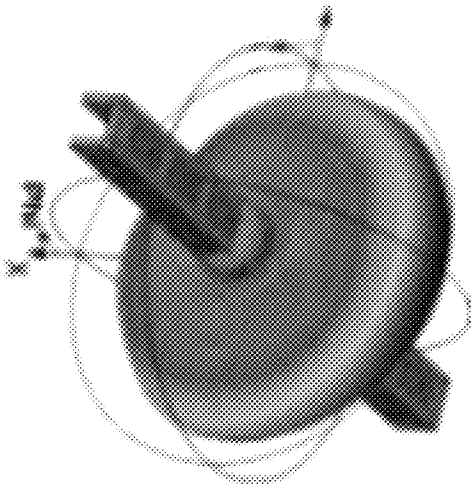
FIG. 33 is the radiation pattern of the microstrip patch antenna array at the end surface of the mobile terminal main board of the disclosure.
Figure 34:
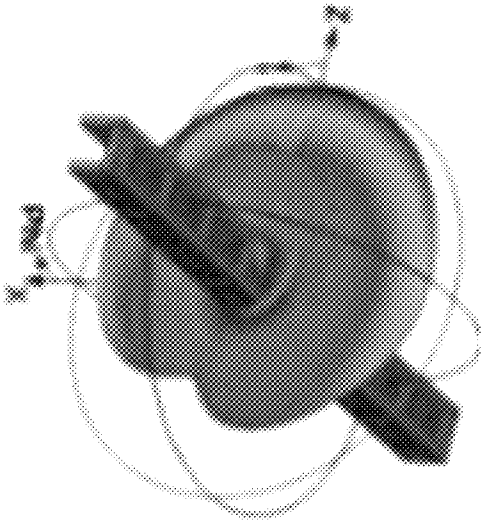
FIG. 34 is the radiation pattern of the microstrip patch antenna array on the lower plane of the mobile terminal main board of the disclosure.
Figure 35:
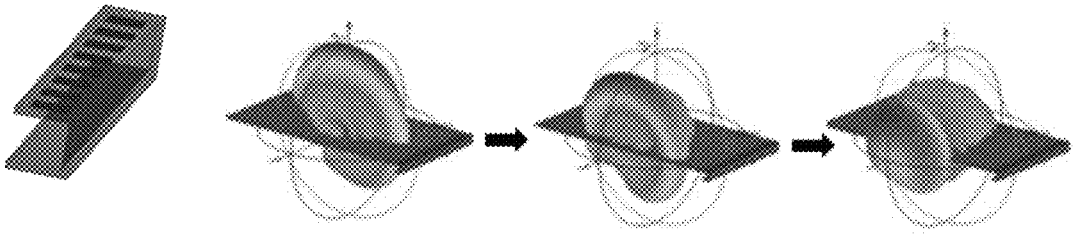
FIG. 35 is the radiation pattern with different scanning angle of the microstrip patch antenna array on the upper plane of the mobile terminal main board of the disclosure.
Figure 36:
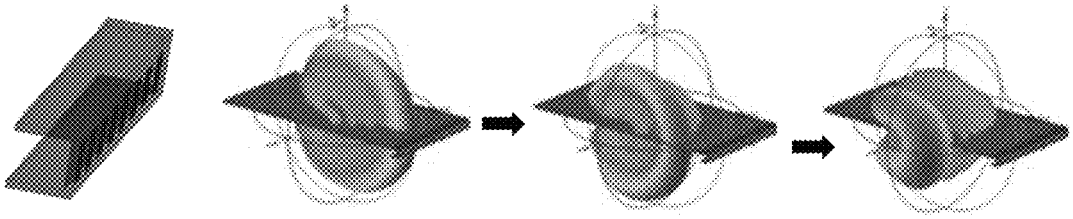
FIG. 36 is the radiation pattern with different scanning angle of the microstrip patch antenna array at the end surface of the mobile terminal main board of the disclosure.
Figure 37:
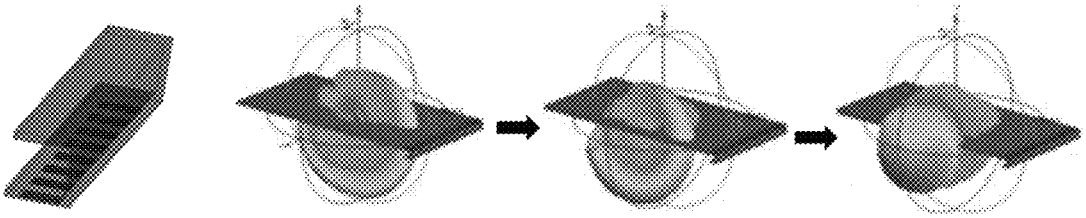
FIG. 37 is the radiation pattern with different scanning angle of the microstrip patch antenna array on the lower plane of the mobile terminal main board of the disclosure.

FIG. 27 illustrates a return loss curve of the micro strip patch antenna element in simulation. FIG. 28 illustrates the radiation pattern of the micro strip patch antenna element. The antenna operates in 28 GHz, and has a radiation pattern with a certain angle above the micro strip patch. The three antenna sub-arrays are disposed on three different planes on the top, the end and the bottom of the mobile terminal main board. The radiation patterns of the three antenna elements are shown in FIGS. 29-31. The radiation patterns of three antenna sub-arrays are shown in FIG. 32-34. The three antenna sub-arrays have good radiation patterns on the top, the end and the bottom of the mobile terminal main board respectively. By changing the phases of the antenna sub-array through the phase shifters, the corresponding beam scanning diagrams are shown in FIGS. 35-37. The beam scanning can be realized by changing the phase of the antenna elements, so that the signal coverage in the free space can be realized. By switching between the different subarrays, the radiation in the desired directions can be selected. So the signal coverage above the hemisphere of the 5G terminal antenna can be realized.

The substrate 61 in this disclosure is a single layer substrate. Based on the comprehensive consideration of functionality and cost, a PCB substrate with permittivity of 4.4 is adopted. The thickness of PCB is 1 mm. The rectangle metal sheet is located at the center of the PCB substrate. The connection point of the coaxial probe and the rectangular metal sheet is disposed in the length direction of the rectangular metal sheet, and has an equal distance to the both sides of the rectangular metal sheet. The length of the rectangular metal sheet is about $\lambda$ g/2, and $\lambda$ g is the wavelength of the electromagnetic wave in the PCB substrate.

The above are the concrete embodiments of the disclosure. The descriptions are very specific and detailed, but it cannot be understood as a limitation of the scope of the disclosure. It should be noted that the ordinary technical staff in the field, without departing from the disclosure concept, also can make some deformation and improvement, these obviously substitute forms belong to the scope of the disclosure.

What is claimed is:

1. A 5G terminal antenna, comprising:

a plurality of antenna sub-arrays, each antenna sub-array being associated with a different radiation pattern; and a switch coupled to each of the antenna sub-arrays to control switching between different ones of the plurality of antenna sub-arrays to generate radiation with a reconfigurable radiation pattern, wherein each antenna sub-array includes a plurality of antenna elements, which can be one or more of a slot antenna, an electric dipole antenna, or a patch antenna, wherein the electric dipole antenna is one of a surface mount technology (SMT) electric dipole antenna, a printed electric dipole antenna, or a metal via electric dipole antenna, wherein when the electric dipole antenna is a surface mount technology (SMT) electric dipole antenna, the surface mount technology (SMT) electric dipole antenna including a symmetrical disposed of a first metal block and a second metal block, wherein a first metal sheet and a second metal sheet are respectively arranged on opposite surfaces of the first metal block and the second metal block.

2. The 5G terminal antenna of claim 1, wherein elements of at least two of the antenna sub-arrays intersect each other.

3. The 5G terminal antenna of claim 1, wherein the switch is disposed between the antenna sub-arrays and a radio frequency (RF) frontend module.

4. The 5G terminal antenna of claim 3, wherein the RF frontend module includes a phase shifter, wherein a first end of the phase shifter is connected with an RF signal input port and a second end of the phase shifter is connected with the switch through a transceiver module.

5. The 5G terminal antenna of claim 1, wherein a patch antenna includes a printed circuit board (PCB) substrate, wherein a metal sheet is disposed on a top of the PCB substrate and a reference ground is disposed on a bottom of the PCB substrate.

6. The 5G terminal antenna of claim 1, wherein a slot antenna can be one of a T-slot antenna, an I-slot antenna, or a co-planar tapered slot antenna.

7. The 5G terminal antenna of claim 6, wherein when the slot antenna is a T slot antenna, which includes a PCB substrate, a metal copper foil is disposed on a top and bottom of the PCB substrate respectively, wherein a T-slot is disposed on the metal copper foil.

8. The 5G terminal antenna of claim 1, wherein an electric dipole antenna includes an upper conductive module and a lower conductive module, wherein a two-layer substrate is located between the upper conductive module and the lower conductive module, wherein a feeder line is located in a middle of the two-layer substrate, wherein the upper conductive module is connected with the feeder line through a metal via and the lower conductive module is connected with a reference ground.

9. The 5G terminal antenna of claim 5, wherein the patch antenna further includes a coaxial probe, wherein an inner core is disposed at a first end of the coaxial probe connected with the metal sheet, and wherein a second end of the coaxial probe passes through the PCB substrate and serves as a feed point.

10. The 5G terminal antenna of claim 7, wherein a metal strip is located in a longitudinal gap of the T-slot on the top of the PCB substrate, and wherein a feed point is located at a lower end of the metal strip, wherein a plurality of metal vias are evenly distributed around the T-slot on the PCB substrate.

11. The 5G terminal antenna of claim 10, wherein when the slot antenna is an I-slot antenna, wherein the I-slot antenna includes a PCB substrate, a metal I-slot passes through the PCB substrate, wherein a metal layer on the PCB substrate is connected with an inner copper plating layer of the metal I-slot, and wherein a coaxial probe is used to feed the metal I-slot and is located in a width direction of the metal I-slot.

12. The 5G terminal antenna of claim 10, wherein when the slot antenna is a co-planar slot antenna, wherein the co-planar slot antenna includes a PCB substrate, a metal copper foil is disposed on a top and bottom of the PCB substrate respectively, wherein two co-planar tapered slots are cut out symmetrically on the metal copper foil.

13. The 5G terminal antenna of claim 12, wherein the co-planar slot includes an I-slot, a co-planar tapered slot, or a rectangular slot, wherein a co-planar waveguide feeder line is located at a symmetrical axis of the co-planar tapered slot and a feed point is located at an end of the co-planar waveguide feeder line.

14. The 5G terminal antenna of claim 1, wherein a two-layer substrate is located between the first metal block and the second metal block, wherein a feeder line is in the middle of the two-layer substrate, and wherein the first metal sheet is connected with the feeder line through metal vias and the second metal sheet is connected with the reference ground.

15. The 5G terminal antenna of claim 1, wherein when the electric dipole antenna is a printed electric dipole antenna, the printed electric dipole antenna includes a first substrate, a second substrate, a third substrate, and a fourth substrate, wherein a first metal sheet is located at a side of the first substrate, wherein a second metal sheet is located on a top of the second substrate and is connected with the first metal sheet, wherein a third metal sheet is located on a bottom of the third substrate, and wherein a fourth metal sheet is located at a side of the fourth substrate and is connected with the third metal sheet.

16. The 5G terminal antenna of claim 15, wherein a feeder line is located between the second substrate and the third substrate, wherein the second metal sheet is connected with the feeder line through the metal vias and the third metal sheet is connected with the reference ground.

17. The 5G terminal antenna of claim 1, wherein when the electric dipole antenna is a metal via electric dipole antenna, the metal via electric dipole antenna includes a first substrate, a second substrate, a third substrate, and a fourth substrate, wherein a first metal via and a second metal via are located at edges of the first substrate and the fourth substrate respectively, wherein a first metal sheet is located on a top of the first metal via, wherein a second metal sheet is located on a bottom of the first metal via and is connected with the first metal sheet through the first metal via, wherein a third metal sheet is located on a top of the second metal via, wherein a fourth metal sheet is located on a bottom of the second metal via and is connected with the third metal sheet through the second metal via, wherein a feeder line is located between the second substrate and the third substrate, wherein the second metal sheet is connected with the feeder line through the metal via and the third metal sheet is connected with the reference ground.

* * * * *